US007387682B2

(12) United States Patent
Miura et al.

(10) Patent No.: US 7,387,682 B2
(45) Date of Patent: Jun. 17, 2008

(54) LIQUID DROP DISCHARGE DEVICE, PRINTER, PRINTING METHOD, AND ELECTRO-OPTICAL DEVICE

(75) Inventors: Hirotsuna Miura, Fujimi-machi (JP); Jun Amako, Matsumoto (JP)

(73) Assignee: Seiko Epson Corporation (JP)

( * ) Notice: Subject to any disclaimer, the term of this patent is extended or adjusted under 35 U.S.C. 154(b) by 455 days.

(21) Appl. No.: 10/762,224

(22) Filed: Jan. 21, 2004

(65) Prior Publication Data

US 2004/0189750 A1 Sep. 30, 2004

(30) Foreign Application Priority Data

| | | |
|---|---|---|
| Jan. 21, 2003 | (JP) | 2003-012705 |
| Feb. 28, 2003 | (JP) | 2003-054672 |
| Feb. 28, 2003 | (JP) | 2003-054673 |
| Nov. 11, 2003 | (JP) | 2003-381756 |

(51) Int. Cl.
*B05C 11/10* (2006.01)

(52) U.S. Cl. ..... 118/669; 118/668; 118/712; 118/713; 347/51; 347/52

(58) Field of Classification Search ..... 118/712, 118/713, 668, 669; 347/52, 51
See application file for complete search history.

(56) References Cited

U.S. PATENT DOCUMENTS 5,722,479 A * 3/1998 Oeftering ..... 164/46

FOREIGN PATENT DOCUMENTS

| | | |
|---|---|---|
| JP | 06-071164 | 3/1994 |
| JP | 06-126955 | 5/1994 |
| JP | 09-216354 | 8/1997 |
| JP | 2000-185392 A | 7/2000 |
| JP | 2002-370345 A | 12/2000 |
| JP | 2001-507139 | 5/2001 |
| JP | 2002-131529 | 5/2002 |
| JP | 2002-202414 | 7/2002 |
| JP | 2002-261048 | 9/2002 |
| JP | 2002-528744 | 9/2002 |
| JP | 2003-106950 | 4/2003 |
| JP | 2004-325944 | 11/2004 |
| WO | WO 98/28650 | 7/1998 |
| WO | WO 00/23825 | 4/2000 |

* cited by examiner

*Primary Examiner*—George Koch
(74) *Attorney, Agent, or Firm*—Harness, Dickey & Pierce, P.L.C.

(57) ABSTRACT

A liquid drop discharge device such as an ink jet device is provided that discharges a liquid drop with high precision. The liquid drop is discharged from a discharge head to a target position of a substrate and a cylindrical laser beam surrounds a trajectory that the liquid drop follows. As a result, the liquid drop can be rebounded by the laser beam to land at a target position of the substrate even if the course of the liquid drop discharged from the discharge head is diverted out of its predetermined trajectory.

16 Claims, 26 Drawing Sheets

LIQUID DROP DISCHARGE DEVICE, PRINTER, PRINTING METHOD, AND ELECTRO-OPTICAL DEVICE

BACKGROUND OF THE INVENTION

1. Technical Field of the Invention

The invention relates to a liquid drop discharge device that discharges liquid drops to a substrate.

2. Description of the Related Art

A device that pattern-prints a liquid material such as liquid ink to a relevant substrate of glass or paper phenol by discharging the liquid material to the substrate (liquid drop discharge device) has been used in a variety of technical fields. Recently, another use has been suggested to pattern-print the wiring of electrical circuits onto a substrate by discharging a metal-diffused solution to the substrate (for example, refer to Japanese Unexamined Patent Application Publication No. 2002-261048)

In a liquid discharge device, a discharge head for discharging a liquid drop is provided over a substrate to discharge the liquid drop to a target position on the substrate. In this case, the relative position of the discharge head and the substrate can be properly adjusted to discharge the liquid drop for pattern printing.

However, in the case of a conventional liquid drop discharge device, a liquid drop may be solidified and clog a discharge port of a discharge head. Thus, the liquid drop may be discharged in an unexpected direction or along a different course by being bent by the force of air resistance. As a result, the liquid drop lands at a position other than its initial target, thereby causing a false wire pattern of an electric circuit. In addition, the metal-diffused solution should not be wasted in consideration of its generally high price.

There has been a method of shortening the gap between a substrate and a discharge head (platen gap) to avoid the influence of air resistance, but this method cannot be applied to a case that there is unevenness on the shape of the substrate. When the weight of a liquid material (weight of ink) to be used is small, the liquid material may be easily influenced by air resistance. Therefore, it may be difficult to obtain an effect of avoiding the influence of air resistance in spite of a short platen gap.

The present invention has been made in consideration of the above problems. It is therefore an object of the present invention to provide a technique of discharging a liquid drop precisely to a target position of a substrate.

SUMMARY

In order to solve the aforementioned problems, the invention provides a liquid drop discharge device, comprising: a discharge head for discharging a liquid drop to a substrate, and trajectory correcting means for applying energy to turn the liquid drop back to a predetermined trajectory when the liquid drop discharged out of the discharge head is diverted from the predetermined trajectory.

According to the liquid drop discharge device, when the liquid drop discharged from the discharge head is diverted out of a predetermined trajectory, energy can be applied in a direction of turning the liquid drop back to the predetermined trajectory. As a result, the liquid drop can be directed to the substrate with high precision.

In this case, preferably, the energy is light energy. According to this liquid drop discharge device, light energy is applied in the direction of turning the liquid drop back to the predetermined trajectory.

More preferably, the trajectory correcting means drives the liquid drop by light pressure generated by the light energy.

Otherwise, preferably, the trajectory correcting means drives the liquid drop by kinetic energy of molecules generated when atmosphere around the liquid drop or the trajectory absorbs the light energy. More preferably, the liquid drop contains a photothermal converting material for absorbing and converting the light energy into heat. As a result, the efficiency of converting the light energy is improved.

In addition, according to the aforementioned liquid drop discharge device, preferably, the trajectory correcting means includes means for emitting a light beam so as to surround the predetermined trajectory of the liquid drop. As a result, a liquid drop can be returned to the predetermined trajectory when the liquid drop is diverted to directions other than its predetermined course.

Further, more preferably, the light beam emitting means includes a laser light source because the discharge head constructed with high precision requires a characteristic of high light condensing.

Moreover, preferably, the trajectory correcting means is constructed to surround the predetermined trajectory of the liquid drop by using a planar light beam obtained by diffracting a light beam.

According to the liquid drop discharge device, a light beam with no gap is used to improve the precision of directing a liquid drop. Additionally, since the trajectory of a liquid drop is surrounded, a need of including a plurality of light sources is eliminated.

Besides, it is preferable that the trajectory correcting means is constructed to surround the predetermined trajectory of the liquid drop by using a cylindrical light beam obtained by diffracting a light beam.

According to the liquid discharge device, a liquid drop is pushed back to the center of the cylindrical light beam. Therefore, the liquid drop can be directed onto the substrate with high precision.

However, the energy density of laser light is highest at the position where a light beam is focused. When a liquid drop passes this position, therefore, it is probable that the liquid drop may be rebounded by the effect of laser light or become smaller in volume by the evaporation of solvent. Therefore, preferably, the trajectory correcting means is constructed to discharge the liquid drop into a region surrounded by the light beam, at a place closer to the light source than another where a diffracted image of the light beam is focused. As a result, it is possible for a liquid drop to avoid being influenced by laser light.

Besides, the light beam is emitted to the substrate from a direction opposite to the discharge head to surround the predetermined trajectory of the liquid drop in the case of using a substrate that can transmit the light beam. According to the structure thus constructed, since a liquid drop cannot cross the light beam, there is no need to consider an influence that may be caused when the liquid drop crosses the light beam.

In addition, in another preferable aspect, the light beam emitting means includes means for probing the timing at which the liquid drop crosses the light beam or its reflected beam in response to a discharge signal of the liquid drop, and means for weakening the intensity of the light beam or for stopping the emission of the light beam at that time. Therefore, it is possible for a liquid drop to avoid being influenced by crossing light beams.

Furthermore, preferably, the liquid drop discharge device further comprises opening/closing means for opening a discharge port of the discharge head when the liquid drop is discharged.

According to the structure thus constructed, it is possible to suppress drying of a solution in a nozzle that results from an air stream generated by the movement of a head unit or heat generation of constructional elements in the device.

In addition, preferably, the discharge port of the discharge head is kept open when the liquid drop is continually discharged. According to the structure thus constructed, when a liquid drop is continually discharged, the nozzle is kept open. Therefore, the unnecessary opening/closing operations can be omitted, so that it is very suitable for a case that a piezo-electric element having a slow opening/closing operation is used.

Furthermore, preferably, the liquid drop discharge device further comprises an enclosure for covering the discharge head, and the enclosure is provided with a hole that passes the liquid drop discharged from the discharge head. According to the structure thus constructed, it is possible to suppress drying of the nozzle or the discharge pipe. In addition, it is possible to prevent a liquid drop from being adhered at a position different from a predetermined one on the substrate because the liquid drop is driven away by an air stream.

Moreover, preferably, the liquid drop discharge device further comprises a sealed vessel for sealing the discharge head and the substrate and pressure reducing means for reducing the pressure in the sealed vessel.

According to the structure thus constructed, generation of an air stream is suppressed in a flying space of a liquid drop. Therefore, it is possible to direct a liquid drop to a predetermined position of the substrate.

Besides, the present invention provides a printing device comprising the aforementioned liquid drop discharge device, and a printing method using the aforementioned liquid drop discharge device. According to the printing device or printing method, for example, a metal-diffused solution can be used for printing wiring onto a substrate. Also, the wiring substrate made by the aforementioned method is very suitable to be used as a constructional element of an electro-optical device.

According to the invention, a liquid drop can be directed onto the substrate with high precision. Besides, a cylindrical light beam can be used to surround a flying liquid drop with no gap. Thus, it is possible to improve the precision of directing the liquid drop. Furthermore, it is possible to suppress drying of a solution in a nozzle that results from an air stream generated by the movement of a head unit or heat generation of constructional elements of the device. In addition, it is possible to prevent a liquid drop from being driven away by an air stream and adhered to a position other than its predetermined one.

DETAILED DESCRIPTION

Hereinafter, embodiments of the present invention will be described with reference to the accompanying drawings.

First Embodiment

Figure 1:
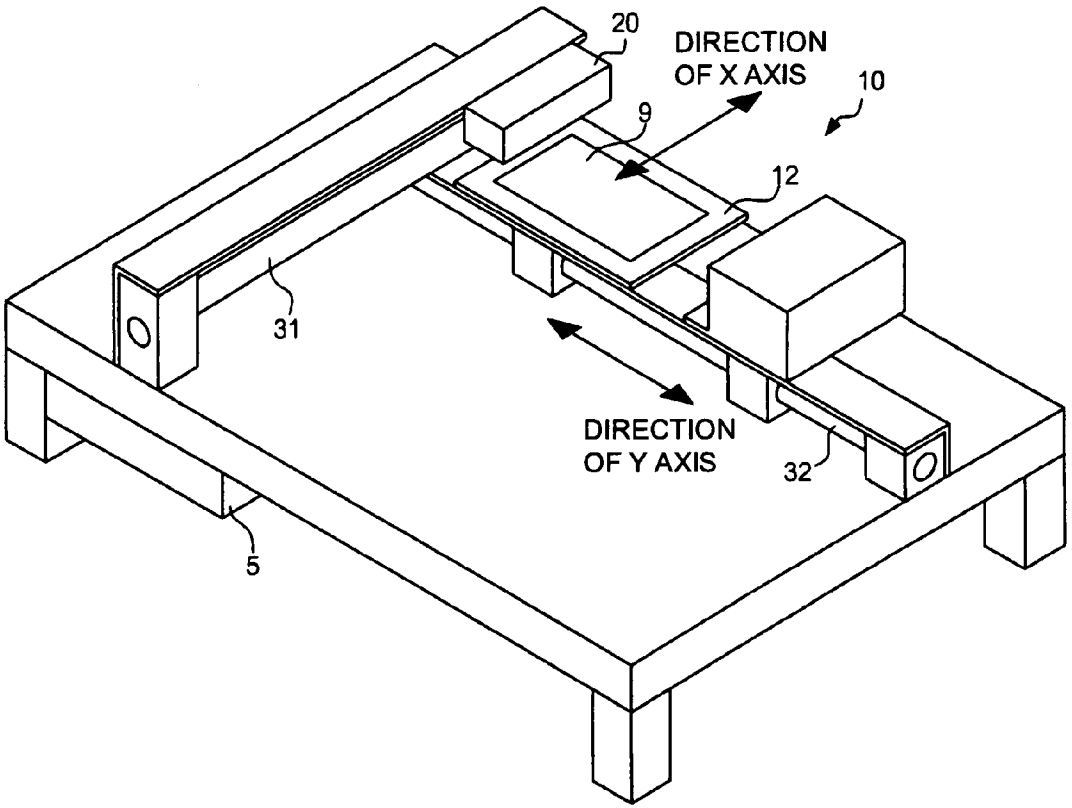
FIG. 1 is a perspective view of an ink jet device 10.

FIG. 1 is a perspective view of an ink jet device 10 (liquid drop discharge device) according to this embodiment.

As shown in FIG. 1, the ink jet device 10 comprises a head unit 20 which discharges liquid drops to a substrate 9. A stage 12 is a mount to set up the substrate 9, a thin plate of paper phenol or glass. In this case, the head unit 20 is constructed to be capable of moving by a slider 31 in the x direction while the stage 12 is constructed to be capable of moving by another slider 32 in the y direction. Therefore, it is possible to adjust the relative position of the head unit 20 and the substrate 9 and discharge a liquid drop to a predetermined position of the substrate 9.

Figure 2:
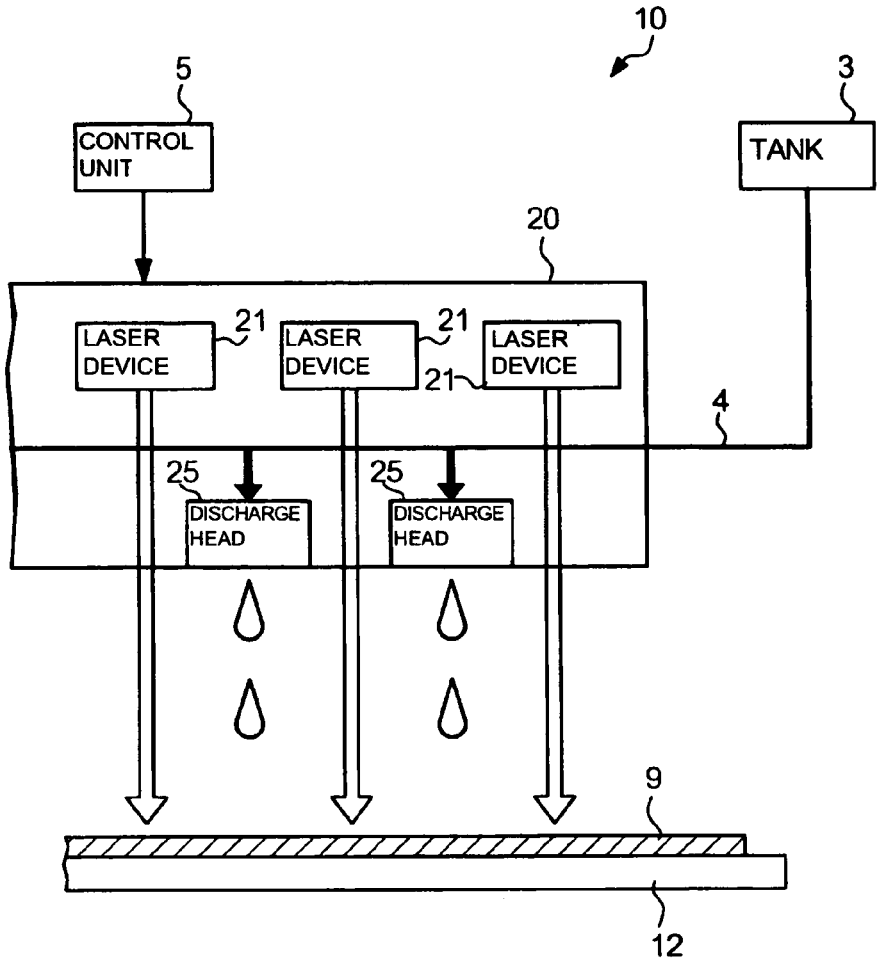
FIG. 2 illustrates the structure of the ink jet device 10.

FIG. 2 is a schematic view illustrating the structure of the head unit 20 of the ink jet device 10. A control unit 5 shown in FIG. 2 is a part to generally control the operation of respective parts of the ink jet device 10 that also includes a central processing unit (CPU) or a memory unit to store a program used by the CPU.

A tank 3 stores a liquid material, a solution (hereinafter referred to as a silver-diffused solution) having n-tetradecan ($C_{14}H_{30}$) into which micro-capsulated silver powder is diffused. As shown in the drawings, the head unit 20 is provided with a plurality of discharge heads 25, and laser devices 21 are provided around the discharge heads 25. The silver-diffused solution stored in the tank 3 is supplied to the discharge heads 25 through piping 4 and then discharged from the discharge heads 25 as liquid drops.

In this embodiment, the diameter of liquid drops discharged out of the discharge heads 25 is about 1 μm.

In addition, a water solution, a water-dispersed solution, an organic solution, an organic dispersed solution or the like may be used as a liquid drop.

Figure 3:
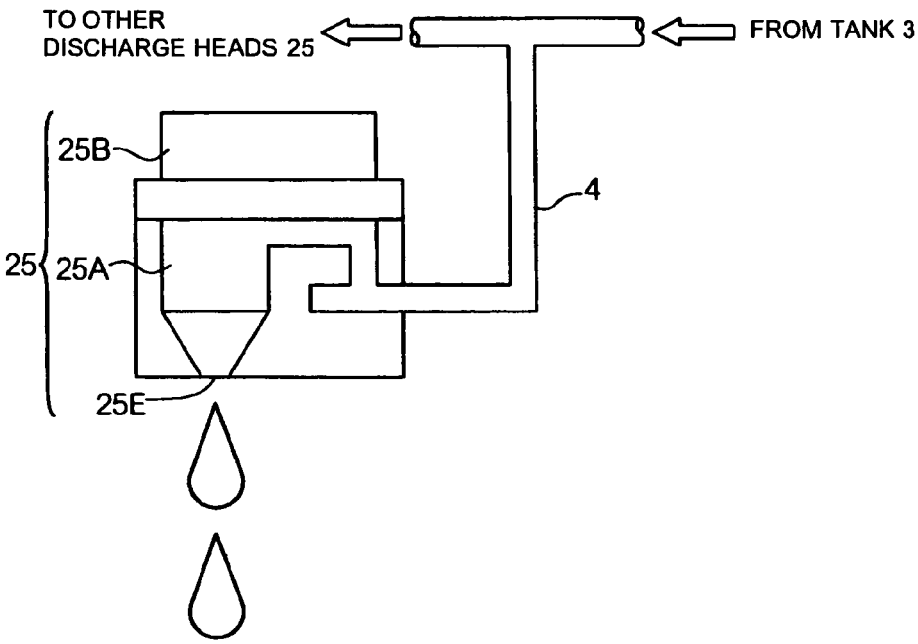
FIG. 3 is a cross-sectional view of a discharge head 25 of the ink jet device 10.

Next, FIG. 3 illustrates a cross-sectional view of a discharged head 25. The solution supplied through the piping 4 is temporarily stored in a liquid chamber 25A. A piezo-electric element 25B has an elongating/shrinking property of its own shape according to a level of a supplied driving signal (voltage signal) under the control of the control unit 5. When the piezo-electric element 25B is elongated, pressure is applied to the liquid chamber 25A to discharge a liquid material in the liquid chamber 25A through a nozzle 25E as a liquid drop. If the nozzle 25E is in its normal state without a problem like clogging, the liquid drop is discharged down through the nozzle 25E vertically onto the surface of the substrate 9.

In addition, the actual head unit 20 comprises twelve (six×two rows) discharge heads 25 constructed as such. Driving signals are respectively supplied to the discharge heads 25 by the control unit 5.

Figure 4:
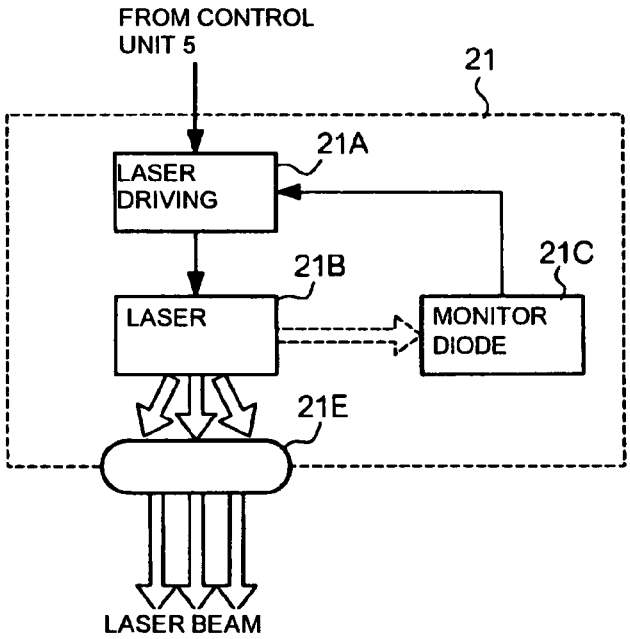
FIG. 4 illustrates the structure of a laser device 21 of the ink jet device 10.

Next, a laser device 21 will be described. FIG. 4 illustrates a structural view of the laser device 21. A laser driving circuit 21A flows current to a laser 21B according to a level of voltage applied under the control of the control unit 5. The laser 21B is a semiconductor laser including a laser diode or the like, emitting laser beams having intensity according to the quantity of flowing electric current. Then, the laser beams emitted by the laser 21B are collected by a lens 21E and outputted as straight laser beams. The surface of the substrate 9 is irradiated vertically with the laser beams.

Some of laser beams emitted from the laser 21B are supplied to a monitor diode 21C. The monitor diode 21C returns a voltage signal relevant to the intensity of the collected laser beams to the laser driving circuit 21A. In this way, the laser driving circuit 21A, laser 21B and monitor diode 21C are included to construct a return circuit which keeps the level of laser beams emitted by the laser 21B constant.

Figure 5:
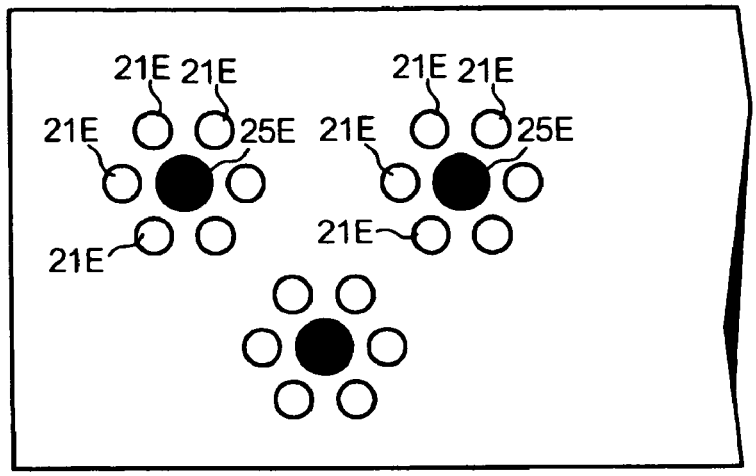
FIG. 5 is a bottom view of a head unit 20 of the ink jet device 10.

The aforementioned laser device 21 is arranged to surround the respective discharge heads 25. FIG. 5 illustrates a bottom view of the head unit 20. As illustrated in the drawing, the lens 21E of the laser device 21 is arranged to surround the position of the nozzles 25E of the discharge heads 25.

Figure 6:
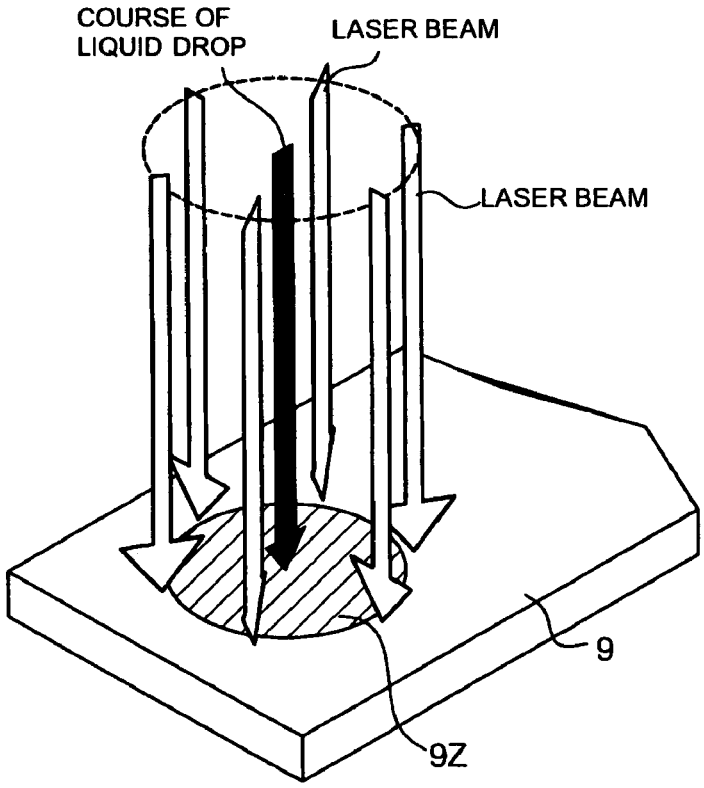
FIG. 6 illustrates the principle of operation of the ink jet device 10.

FIG. 6 illustrates and a proceeding direction (trajectory) of a liquid drop and laser beams when the liquid drop is discharged and laser beams are emitted. In addition, FIG. 6 illustrates one discharge head 25 and a laser device 21 arranged around the discharge head 25.

If the nozzle 25E is not clogged and air resistance is negligible, as shown in FIG. 6, the liquid drop discharged through the nozzle 25E fall down (lands) to a target position of the substrate 9. In this case, the target position 9Z is adjusted by a relative position of the head unit 20 and the stage 12.

Figure 7:
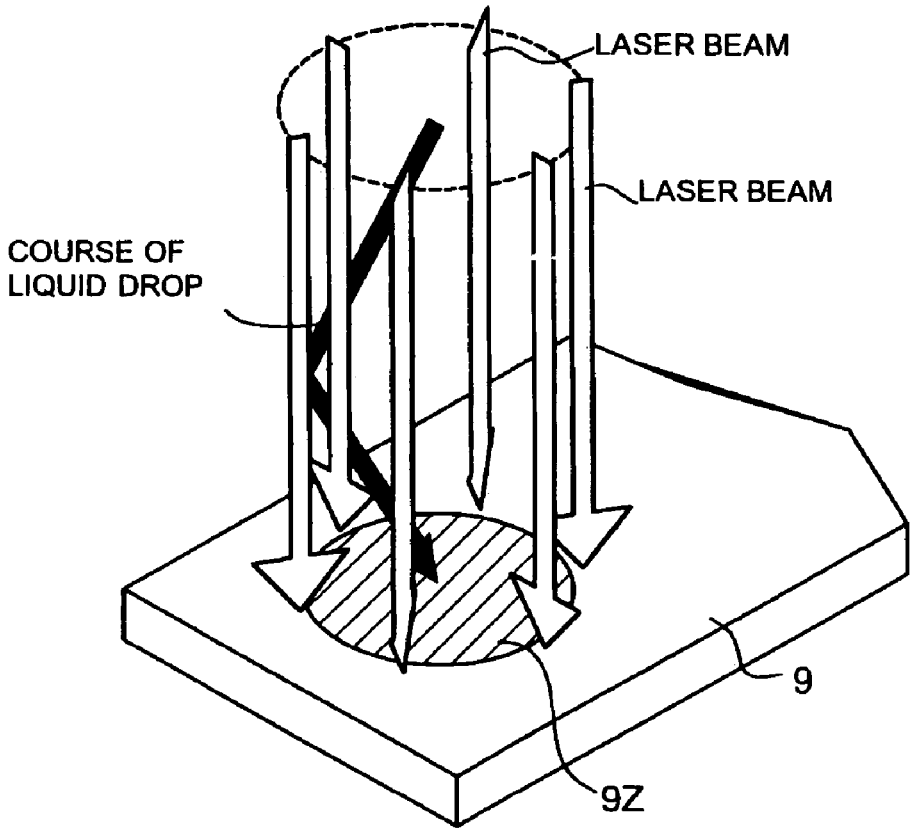
FIG. 7 illustrates the principle of operation of the ink jet device 10.

On the other hand, FIG. 7 illustrates a case that the proceeding direction of a liquid drop is bent by the clogging of a nozzle 25E or air resistance.

As shown in FIG. 7, the proceeding direction of a liquid drop can be bent to a direction different from the target position 9Z of the substrate 9, so that the liquid drop may collide with any of the laser beams. Accordingly, the collision rebounds a liquid drop to change its proceeding direction for precise landing at the target position 9Z of the substrate 9. FIG. 7 illustrates an instance where a liquid drop collides with the laser beams only once. However, the liquid drop may be finally directed to the target position 9Z after repetition of several collisions.

In this case, an effect of a liquid drop made by laser beams will be described below. A liquid drop has two types of effects while flying in a space surrounded by laser beams.

Light pressure (reaction of photon collision); and

Reaction of evaporation of liquid caused by light heat transforming thermal energy.

An effect of light pressure is apparent when the diameter of a liquid drop is very small. In this case, the wavelength of laser beams needs to be optimized according to the type of a liquid drop and it should not be absorbed by the liquid drop. For example, a YAG (Yttrium-Aluminum-Garnet) laser having the wavelength of 355 nm or 1064 nm, an Ar laser having the wavelength of 500 nm or the like may be used. Further, the effect of light pressure is apparent even when the diameter of a liquid drop is very small, for example, when the liquid drop is flying in deceleration to get the solvent to evaporate.

With the second effect, when a liquid drop approaches laser beams, the thermal energy of the laser beams raises the ambient temperature at a position close to the laser beams of the liquid drop or on the trajectory of the liquid drop to vaporize molecules. Then, the kinetic energy of molecules generating in vaporization changes the proceeding course of the liquid drop when the liquid drop gets far from laser beams. The effect of evaporation is apparent when the laser beams have a relatively long wavelength like a $CO_2$ laser having the wavelength of 10 μm. In this case, if light heat transforming materials like dyes that absorb the laser beams having the relevant wavelength and transform it into heat can be mixed in ink solvent to achieve a greater effect.

In the aforementioned embodiment, there is a gap between laser beams. However, in order to prevent a liquid drop from getting out of the gap of the laser beams, it is preferable that a determination made about the gap of the laser beams after the diameter of a liquid drop and that of the laser beams are considered. In this case, the phenomenon that the liquid drop is rebounded by the laser beams can be interpreted on the basis of the kinetic energy generating in vaporization or the kinetic quantity of a liquid drop. Therefore, a simulation experiment should be performed in advance to obtain conditions proper for rebounding by laser beams, so that all the conditions can be set up to prevent a liquid drop from getting out of the gap of the laser beams.

As described above, according to the ink jet device 10, even when the proceeding course of a liquid drop is bent by clogging of the discharge head 25 or an effect of air resistance, the liquid drop is rebounded by surrounding laser beams to change its proceeding course, thereby being directed to its initial target position. The description has been completed on the operation of the ink jet device 10 according to this embodiment.

Figure 8:
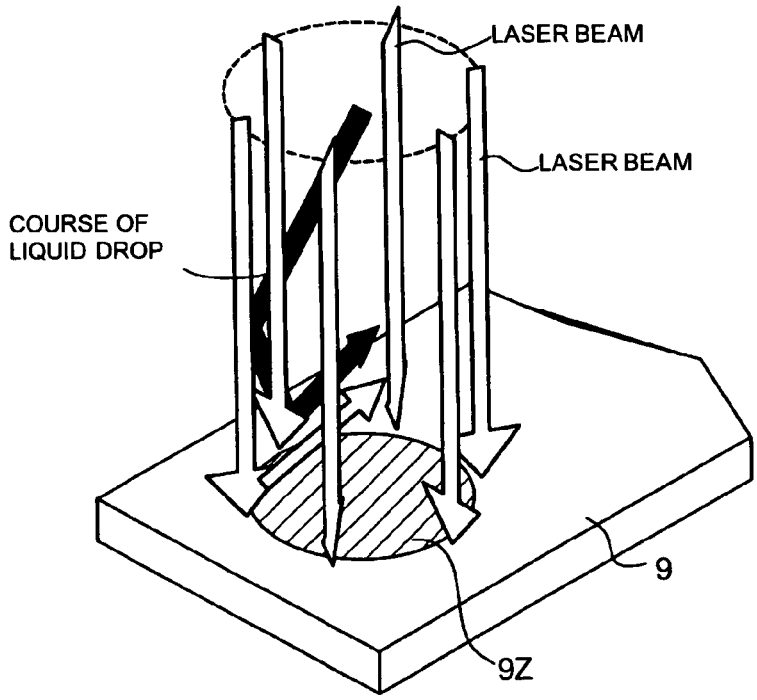
FIG. 8 illustrates the principle of operation of the ink jet device 10.

Further processes will be performed in the present embodiment. First, the laser beams emitted to the substrate 9 are reflected at the surface of the substrate 9. If there is unevenness on the surface of the substrate 9, the laser beams are scattered on the surface of the substrate 9. In this case, as shown in FIG. 8, it is probable that the scattered beams (reflected beams) of the laser beams may be rebounded to directions other than the predetermined proceeding course of a liquid drop.

In order to avoid such a situation, the control unit 5 of the ink jet device 10 controls the timing of the discharge of a liquid drop and that of emitting laser beams.

Figure 9:
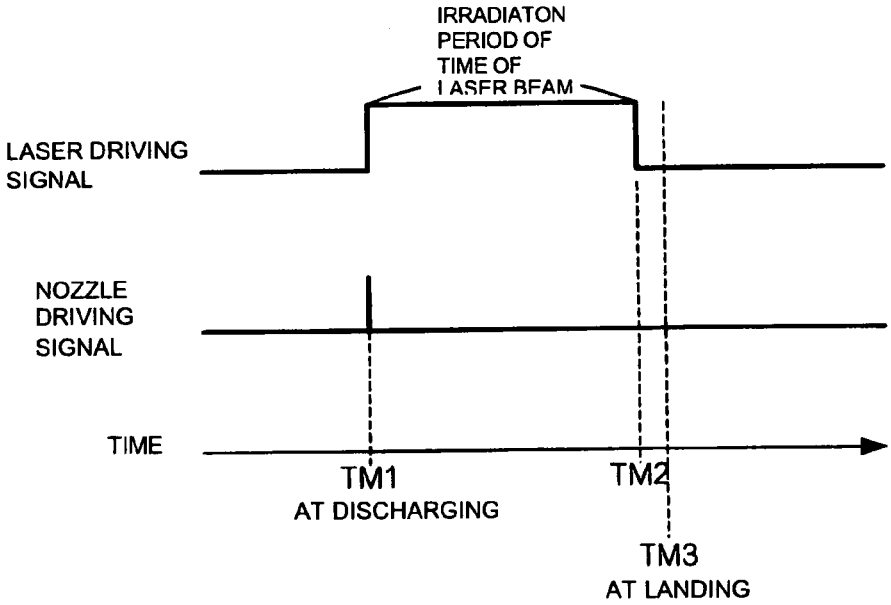
FIG. 9 is a timing chart illustrating the control contents of a control unit 5.

FIG. 9 is a timing chart illustrating the control contents of the control unit 5 when one liquid drop is discharged out of the head unit 20 to the substrate 9.

First, at time TM1, the control unit 5 supplies a driving signal to the piezo-electric element 25B of the discharge head 25, and one liquid drop is discharged through the nozzle 25E. At the same time, the control unit 5 supplies a driving signal to a laser driving circuit 21A of the laser device 21 and initiates the emission of laser beams from the laser 21B. The laser beams emitted from the laser 21B are collected by a laser 21E and radiated to the substrate 9 as straight laser beams.

Thereafter, the liquid drop is directed to the substrate 9 at time TM3. A time interval between times TM1 and TM3 is obtained by dividing a gap D between the nozzle 25E and the substrate 9 with falling speed V of the liquid drop.

The control unit 5 ceases to supply a driving signal to the laser driving circuit 21A at time TM2 that is a little ahead of the time TM3 (for example, just a few micro-seconds earlier), and prevents laser beams from being emitted by the laser 21B. If the liquid drop is directed to the substrate 9 by the aforementioned method, laser beams are not emitted. As a result, it is possible to avoid a defect by preventing a liquid drop from being rebounded by the reflected beams (scattered beams) of the laser beams.

If the surface condition of the substrate 9 is already known, the reflection course (direction of reflected beams) of laser beams can be investigated by a simulation experiment in advance. The investigation may make it possible to control the timing of allowing emission of laser beams so that the reflected beams do not collide with the liquid drop. The aforementioned method is particularly effective in the case of manufacturing a wiring pattern or a display panel, in other words, when a printing pattern is regular or when a pattern shape is revealed by CAD data.

As described above, according to the embodiment, a liquid drop can be directed to the substrate with high precision. This, for example, makes it possible to print wire onto a substrate with high precision by using a solution dispersed with metal particles.

Modification of the First Embodiment

The embodiment described above may be modified as described below.

The number of laser devices 21 related to one discharge head 25 is arbitrary.

Figure 10:
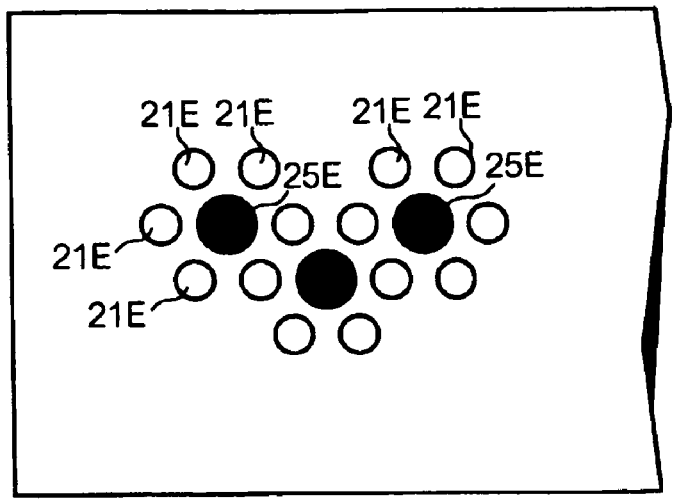
FIG. 10 illustrates a modification of the first embodiment.

Also, as shown in FIG. 10, there may be provided only one laser device 21 (only lens 21E is shown in the drawing) that is also used for correcting the proceeding direction of a liquid drop discharged from the neighboring discharge head 25.

In case that the diversion (bending) of the proceeding direction of a liquid drop is restricted to a certain one, the laser device 21 may be arranged to emit laser beams only in the relevant direction.

Figure 11:
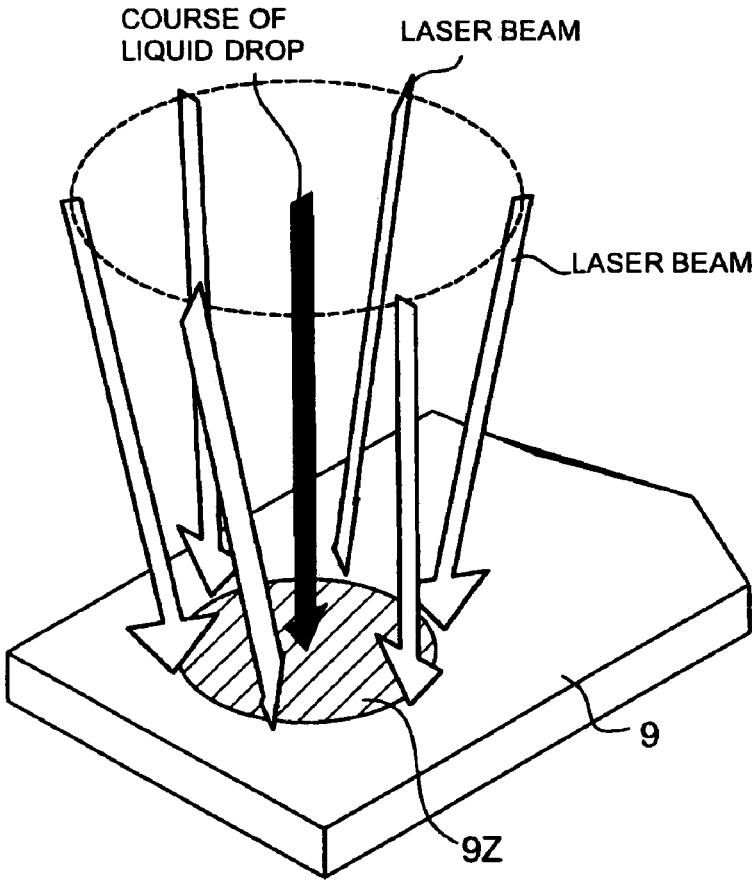
FIG. 11 illustrates a modification of the first embodiment.

The proceeding direction of a liquid drop and that of laser beams may not be parallel to each other. As shown in FIG. 11, if laser beams are emitted to surround the target position 9Z of the substrate 9, the liquid drop is directed to the target position 9Z as described above in the embodiment.

In addition, when the liquid drop is directed to the substrate 9, it is preferable to not allow emission of laser beams but to reduce the level of laser beams. This makes it possible to prevent a liquid drop from being rebounded by the scattered beams (reflected beams) of emitted laser beams.

A solution having a dispersion of metal powder other than silver may be used as liquid material. In other words, if a liquid drop is discharged to form a conducting layer, any solution dispersed with copper or steel besides a silver-dispersed solution may be used. If there is any solution that can disperse metal, any solution other than n-tetradecan ($C_{14}H_{30}$), for example, water or alcohol, may be used.

Figure 12:
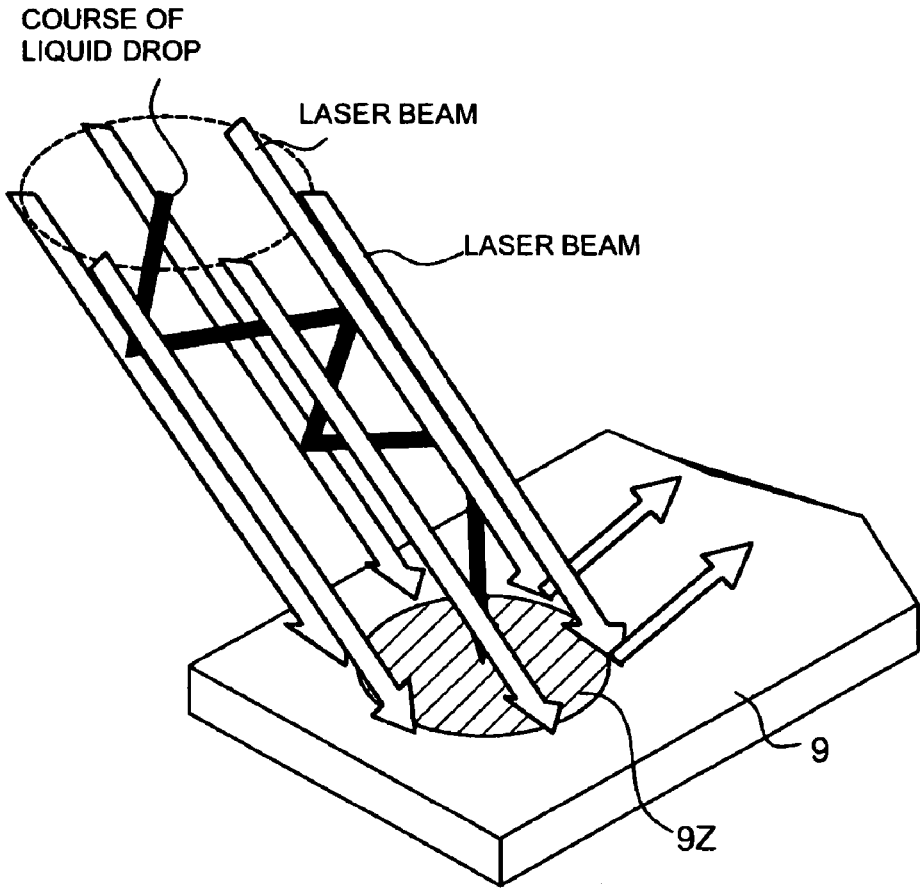
FIG. 12 illustrates a modification of the first embodiment.

As shown in FIG. 12, there may be a target position 9Z at a position inclined downward as seen from the discharged head 25 (nozzle 25E). In this case, if laser beams are designed to emit around the target position 9Z, a liquid drop repeatedly collides with laser beams and finally manages to reach the target position 9z. Further, in the case of this modification, since there is no problem of disturbing the proceeding course of a liquid drop due to the reflected beams of laser beams, there is no need to control the emission of laser beams at the time of directing the liquid drop.

The ink jet device 10 according to this embodiment can discharge the liquid material stored in the tank 3 to the substrate 9 as a liquid drop with high precision of location. Therefore, the ink jet device 10 can also be used for purposes other than making the pattern wiring of electric circuits onto the substrate 9. For example, in the case of a liquid crystal display device, the ink jet device 10 can be used for discharging a pigment composition (liquid material) onto a glass substrate (substrate 9) as a liquid drop, thereby forming a color filter. In addition, the ink jet device 10 can also be utilized for a biological experiment in which a cell solution (liquid material) is discharged to a biomembrane (substrate 9) with high precision of location.

A liquid drop may be discharged perpendicularly toward the upper direction. According to the aforementioned method, since the landing impact of a liquid drop gets weak, it may be possible to prevent the liquid drop from rolling or splashing on the substrate.

Any means other than laser beams may be used for applying energy to guide a liquid drop to a predetermined position. For example, generally used light or thermal energy except laser beams may be used. Also, there may be other methods that can achieve similar effects by making particles collide with a liquid drop.

Second Embodiment

Hereinafter, a second embodiment will be described according to the present invention.

Figure 13:
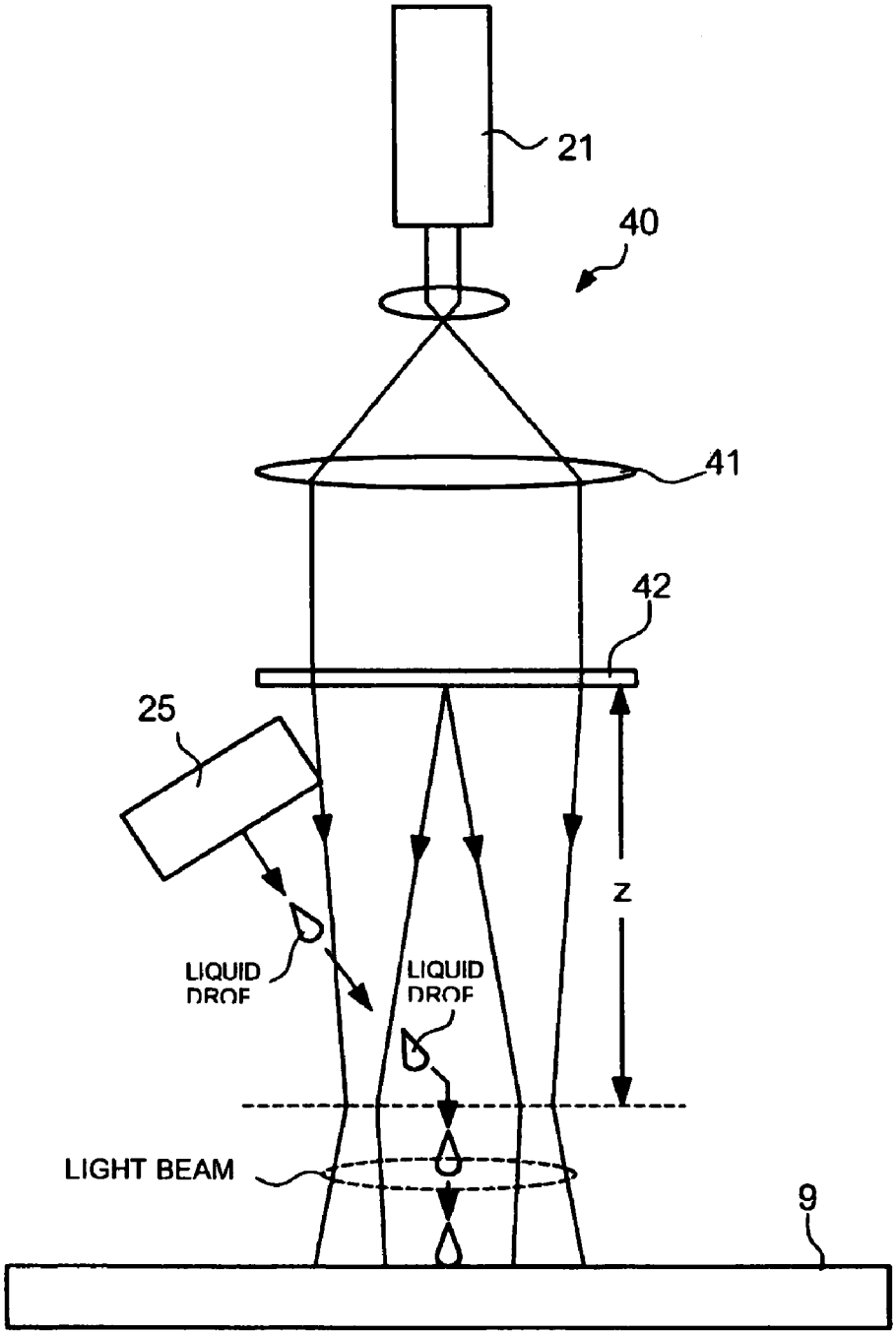
FIG. 13 illustrates a head unit 40.

FIG. 13 illustrates the structure of a head unit 40 according to a second embodiment. The head unit 40 comprises a laser device 21 and a discharge head 25, similar to what have been described in the first embodiment, and further comprises a collimator 41 and a diffracting element 42. The incidence of laser beams emitted from the laser device 21 to the collimator 41 makes it possible to obtain parallel beams. Further, the incidence of the parallel beams result in a cylindrical light beam.

Figure 14A:
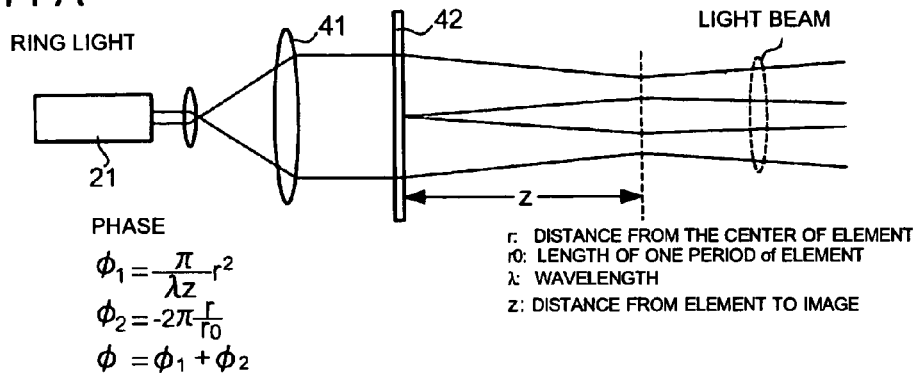
FIG. 14 illustrates an example of a diffracting element.
Figure 14B:
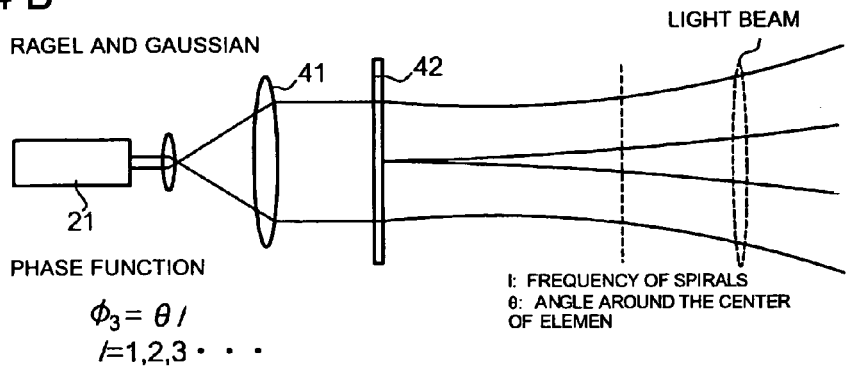
Figure 14C:
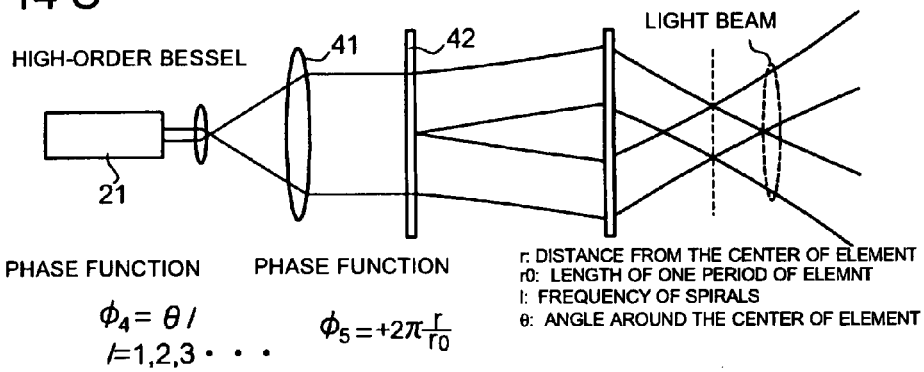

Herein, a description will be made about the diffracting element 42. The diffracting element 42 is formed with unevenness on a transparent plate of quartz glass or the like by using electronic beams. The incidence of parallel beams to the diffracting element 42 brings up a phase difference to obtain a cylindrical light beam. FIG. 14 illustrates three representative types of analysis elements. The analysis elements generate a phase difference in the parallel beams according to a phase function shown in the drawing. FIG. 14(*a*),FIG. 14(*b*) and FIG. 14(*c*) are respectively a phase function of ring light, Ragel and Gaussian function, and high-order Bessel function. In FIG. 14(*c*), light is lost by interference at a rhomboid part where the light beams cross each other. The proceeding course of a liquid drop is surrounded using the part where the light is lost. In addition, it is possible to reduce the diameter of the cylinder as small as the wavelength of the light by the combination of a suitable diffracting element 42. Further, an axicon prism may be used as the diffracting element 42.

In the embodiment, a cylindrical light beam made as described above is used to control the proceeding course of a liquid drop. FIG. 13 illustrates an example using ring light shown in FIG. 14(*a*). The center of the cylindrical light beam is made to impinge upon a target position of the substrate 9 where the liquid drop should land. Then, a liquid drop is discharged through the discharge head 25 provided obliquely above the cylinder.

On the other hand, since the energy density of laser beams gets the highest at a position (a position as far as the distance Z from the diffracting element 42) where the light beam is focused, if the liquid drop crosses the laser beams at that position, the liquid drop is rebounded by the effect of the laser beams or the volume of a liquid drop get smaller due to the vaporization of solvent. In this case, according to the embodiment, the position of discharging a liquid drop is a position closer to the diffracting elements than a position where the light beam is focused. Thus, it becomes difficult for a liquid drop to be influenced by the laser beams.

The speed of discharging a liquid drop is already known. Thus, it is possible to calculate the time where the liquid drop crosses the laser beams by the speed of discharging a liquid drop and the discharge signal supplied to the discharge head. At this time, it would be preferable to weaken the intensity of laser beams or to stop its emission. Therefore, proper timing can prevent a liquid drop from being influenced by crossing the laser beams.

The liquid drop discharged within the cylindrical light beam lands at the desired position by being rebounded by the light beam, similarly to the first embodiment, even if the proceeding course of a liquid drop is diverted out of its original one.

In addition, there may be used a head unit 50 or another head unit 60 whose structure will be described below.

Figure 15:
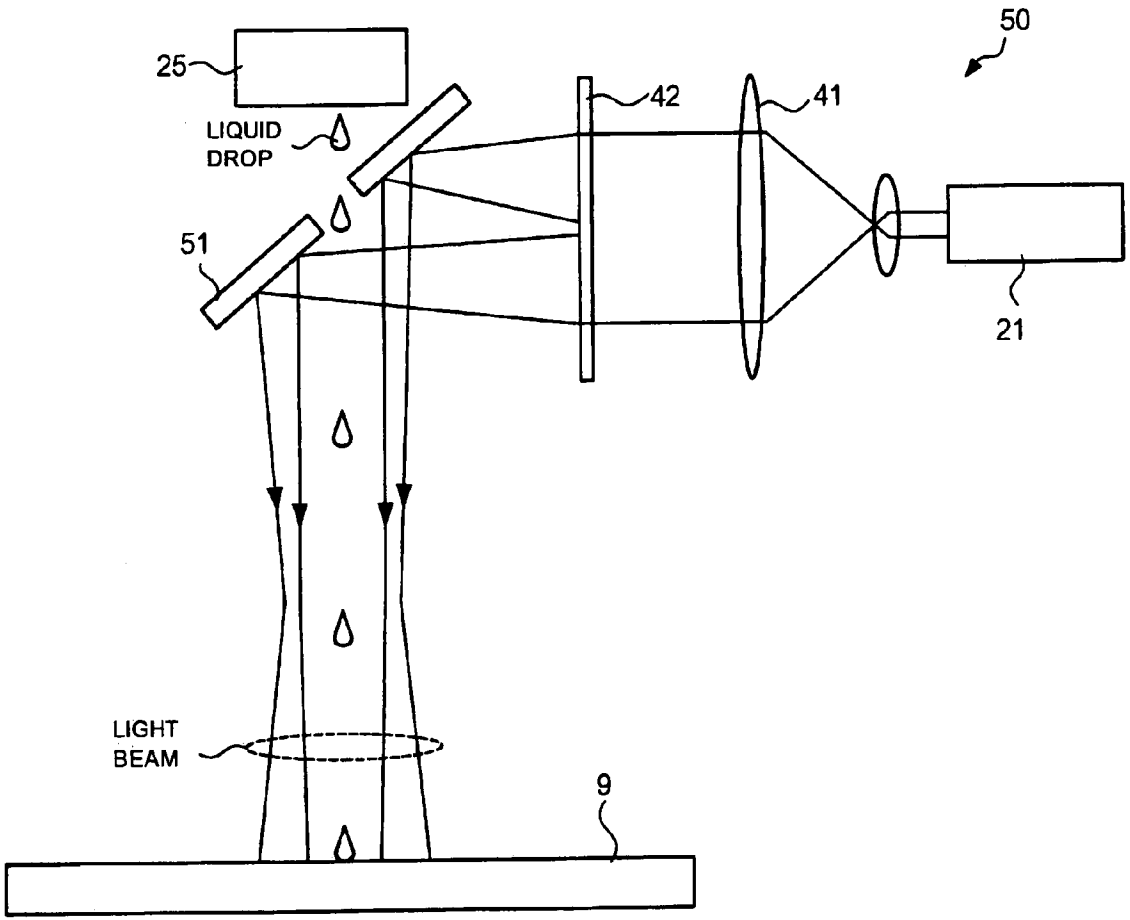
FIG. 15 illustrates a head unit 50.

FIG. 15 illustrates a head unit 50. The laser beams emitted from the laser device 21 in a direction parallel to the substrate 9 pass the collimator 41 and the diffracting element 42 to become a cylindrical light beam. Then, the light beam is incident on a mirror 51. The light beam incident on the mirror 51 proceeds farther after the proceeding course of the light beam changes to a direction vertical to the substrate 9. Then, the light beam having its changed proceeding course or cylindrical light beam is maintained. A hole is formed at the center of the mirror 51 with a diameter sufficient to pass a liquid drop, in other words, the liquid drop discharged from the discharge head 25 passes through the hole and falls within the cylinder of a light beam. Thus, the course of the liquid drop is changed by the mirror 51. In this case, the liquid drop crosses the light beam. It is preferable to make the liquid drop cross the light beam at a position ahead of a position where the light beam is focused.

Figure 16:
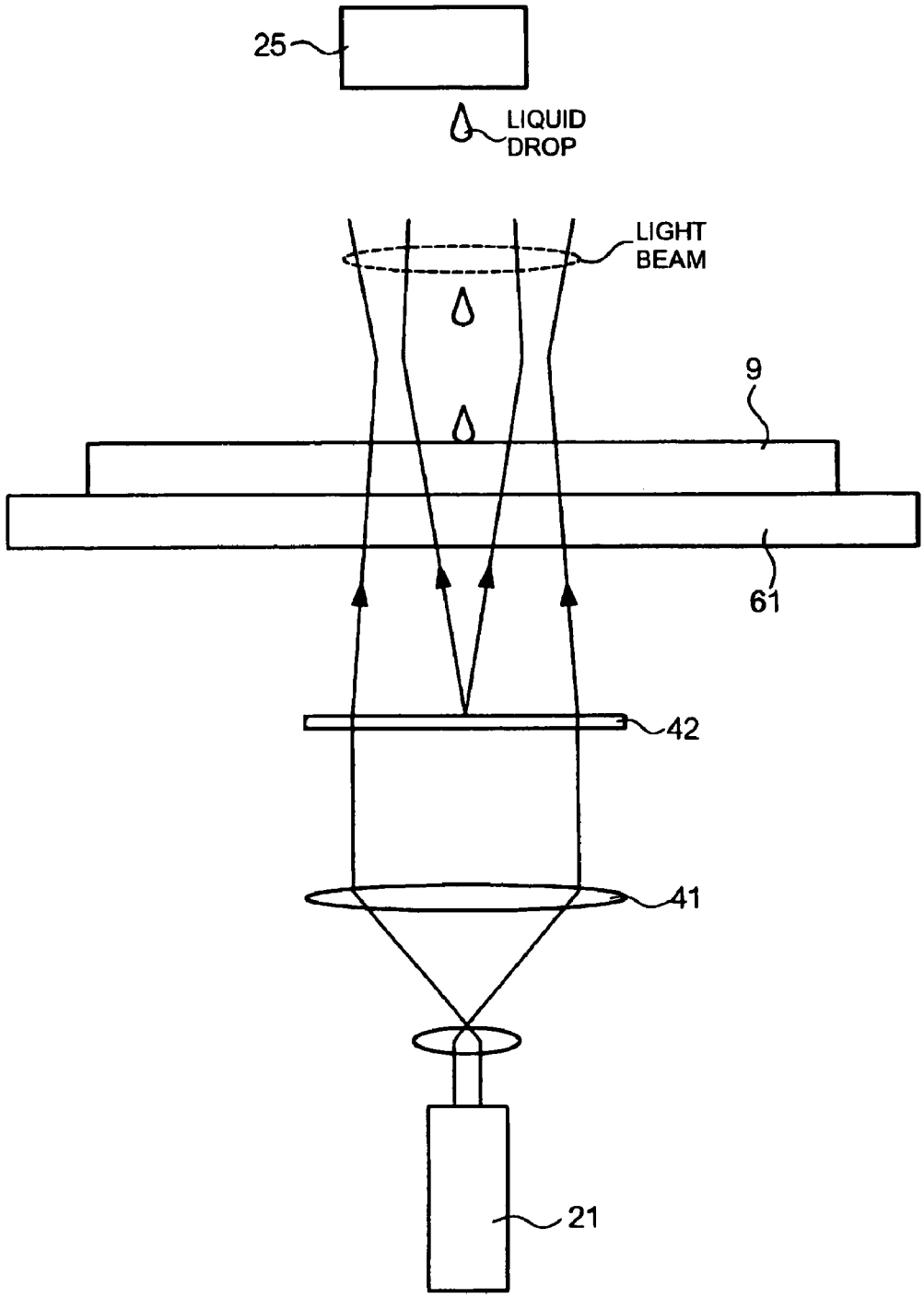
FIG. 16 illustrates a head unit 60.

FIG. 16 illustrates a head unit 60. A stage 61 is a plate made of quartz glass or the like. The laser device 21, a collimator 41 and a diffracting element 42 are arranged opposite to the stage 61 as seen from the discharge head 25. The laser beams emitted from the laser device 21 pass through the collimator 41 and the diffracting element 42, thereby forming a cylindrical light beam. The light beam passes through the stage 61. The liquid drop discharged from the discharge head 25 never crosses the light beam, so that it is not necessary to consider an effect made by the liquid drop that crosses the light beam. Besides, according to the structure, the discharge head 25 can be placed closer to the substrate 9 than when the head unit 40 or the head unit 50 is used. Therefore, it is possible to improve the precision of landing a liquid drop.

As described above, according to the embodiment, a liquid drop can be directed to the substrate with high precision. For example, this makes it possible to print wiring lines on a substrate with high precision by using a solution dispersed with metal particles. Since a gap is never formed in the light beam, it is possible to improve the precision of landing a liquid drop. In addition, it is not necessary to arrange a plurality of light sources for surrounding the trajectory of a liquid drop.

Modification of the Second Embodiment

The scope of the present invention is not limited to the embodiments described above, but modification can be made to the invention as described below.

Figure 17:
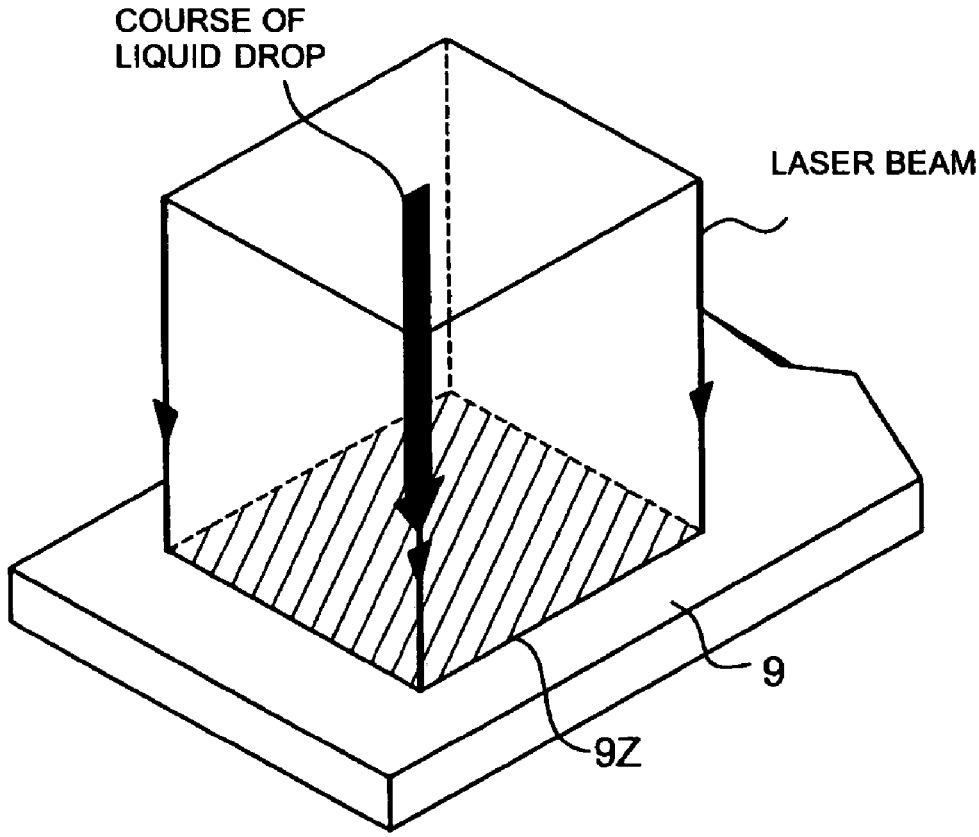
FIG. 17 illustrates an example using a combination of planar light beams.

Instead of using the cylindrical light beam, as shown in FIG. 17, the light beam may be constructed such that the proceeding course of a liquid drop is surrounded with a light beam of a quadratic prism or triangular prism by the combination of planar light beams.

Besides, if the proceeding course of a liquid drop is diverted restrictively to one direction, laser beams may be emitted only in the relevant direction.

In addition, the linear light beams may be emitted cylindrically or polygonally. According to the structure thus constructed, it is possible to obtain the same effect as when the cylindrical or polygonal pillar-shaped light beam is used. By using a liquid shutter that can obtain a desired shape of permeable light, it is possible to emit cylindrical or polygonal pillar shapes of a light beam.

Third Embodiment

Next, a third embodiment of the present invention will be described below. According to the third embodiment, a cover for protecting the liquid drop discharging nozzle from drying is provided in the ink jet device constructed according to the first or second embodiment.

Figure 18:
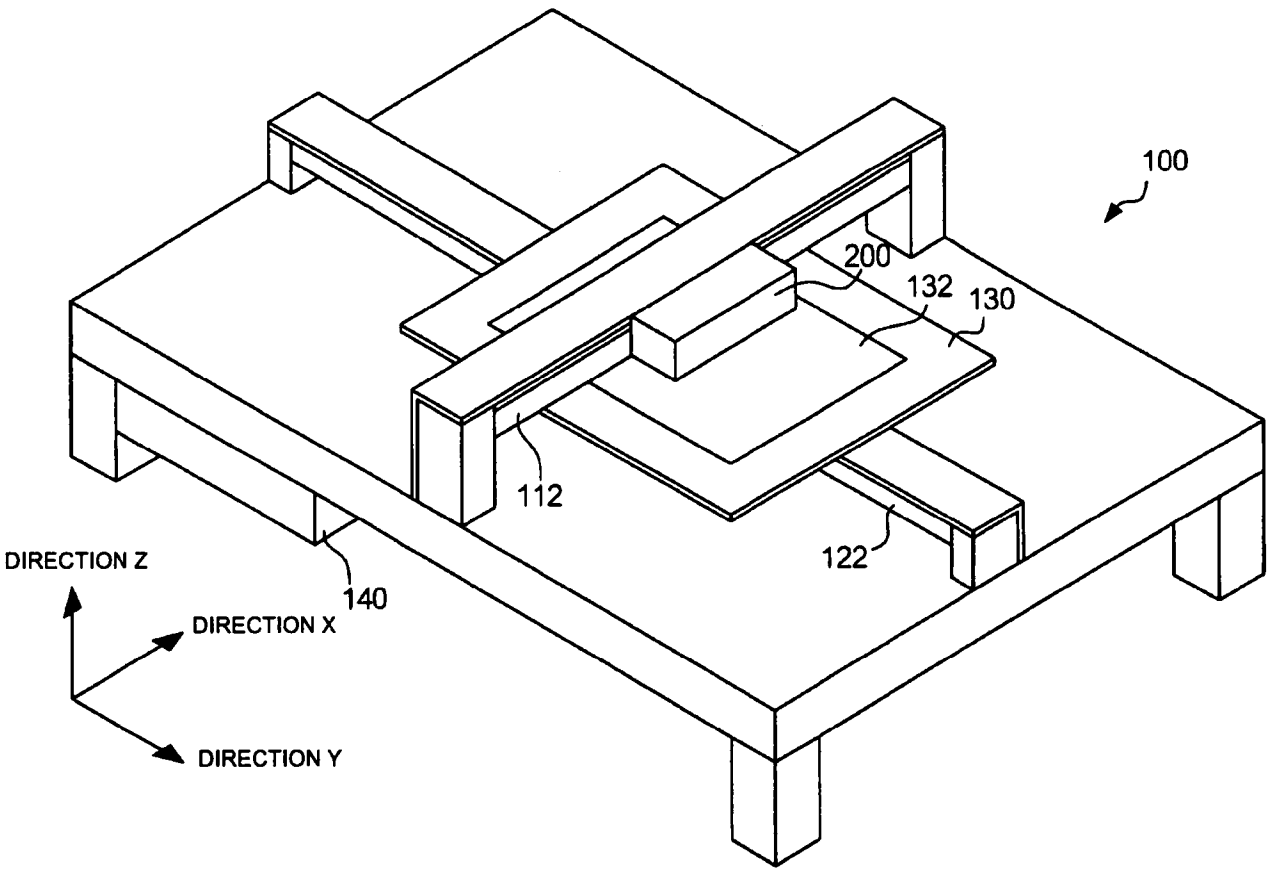
FIG. 18 is a perspective view of an ink jet device 100.

FIG. 18 is a perspective view of an ink jet device 100 (liquid drop discharge device) related to the embodiment. As shown in FIG. 18, the ink jet device 100 comprises a head unit 200 to discharge a liquid drop to a substrate 132. A stage 130 is a mount to set up the substrate 132, a thin plate of paper phenol or glass. In this case, the head unit 200 is constructed to be capable of moving by a slider 112 in the x direction while the stage 130 is constructed to be capable of moving by another slider 122 in the y direction. Therefore, it is possible to adjust the relative position of the head unit 200 and the substrate 132 and discharge a liquid drop to a predetermined position of the substrate 132.

Figure 19:
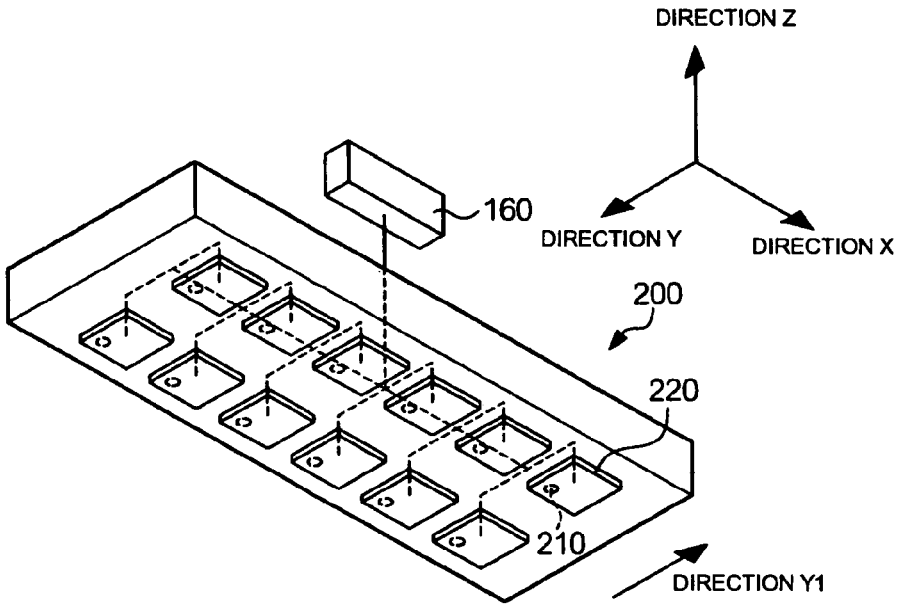
FIG. 19 is a perspective view of a head unit 200.

FIG. 19 is a perspective view of the head unit 200. The head unit 200 includes twelve nozzles 210 in total to discharge liquid drops. Also, the head unit 200 includes twelve piezo-electric elements arranged in total, correspondingly to the nozzles 210. The piezo-electric elements 220 change their shape to shrink in the direction Y1 with the application of voltage, thereby making the closed nozzles 210 open. Further, the head unit 200 includes a discharge control circuit 160 that generates a voltage V1 which will shrink the piezo-electric elements 220 and a voltage V0 which will elongate the piezo-electric elements 220 according to discharge driving data supplied from the driving control circuit 140 (see FIG. 18) and a discharge signal of discharging a liquid drop.

Figure 20:
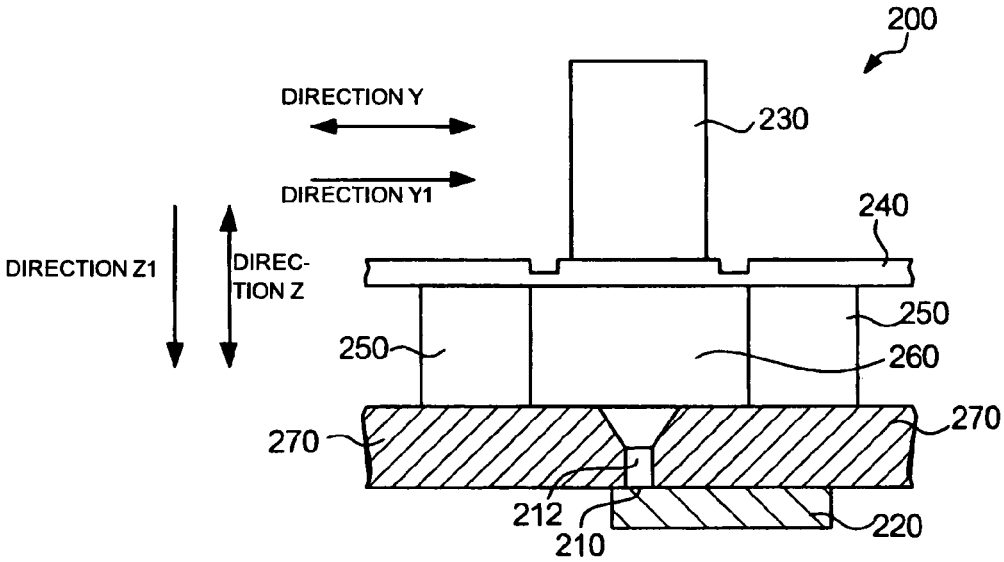
FIG. 20 is a cross-sectional view cut along the vertical plane of the head unit 200.

FIG. 20 is a cross-sectional view cut along the vertical plane of the head unit 200. The head unit 200 is provided with a liquid chamber 260 filled with a solution, an object to be discharged, in a space partitioned with a partitioning portion 250. The liquid chamber 260 is arranged correspondingly to each nozzle. A vibrating plate 240 is joined to the liquid chamber 260. The vibrating plate 240 shrinks the liquid chamber 260 by the elongation of the piezo-electric element 230 in the direction of Z1 on the basis of the discharge driving voltage supplied from the discharge control circuit 160. A discharge pipe retainer 270 supports a discharge pipe 212 which leads the solution flowing from the liquid chamber 260 to the nozzle 210.

Figure 21:
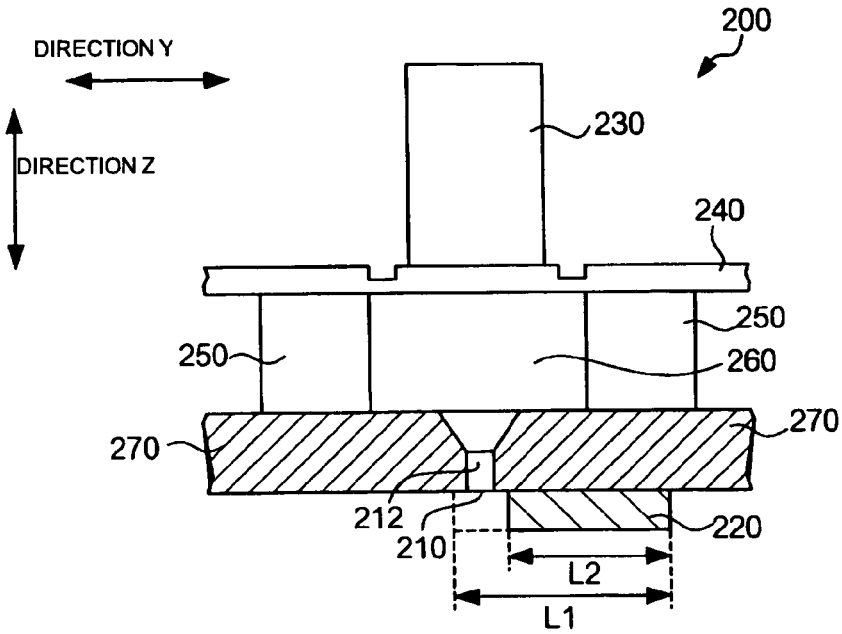
FIG. 21 illustrates the operation of a piezo-electric element 220.

FIG. 21 illustrates the operation of a piezo-electric element 220. When the applied voltage of the piezo-electric element 220 is changed by the discharge control circuit 160 from voltage V0 to voltage V1, the length of the piezo-electric element 220 shrinks from L1 to L2, making the nozzle 210 open. Besides, if the applied voltage of the piezo-electric element 220 is changed from voltage V1 to voltage V0, the length of the piezo-electric element 220 elongates from L2 to L1, making the nozzle 210 close.

Figure 22:
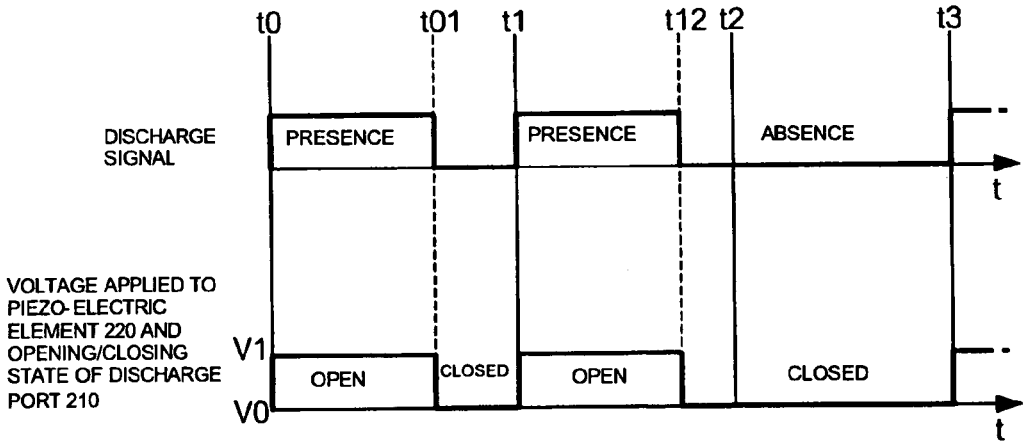
FIG. 22 is a timing chart illustrating the opening/closing states of a nozzle 210.

FIG. 22 is a timing chart illustrating the discharge signals supplied from the discharge control circuit 160 and changes in the opening/closing states of nozzles 210 by the piezo-electric elements 220.

At time t0, the discharge signal of a liquid drop rises and a voltage V1 is applied to the piezo-electric element 220 from the discharge control circuit 160. Then, the piezo-electric element 220 shrinks to open the nozzle 210 (an 'opening' shown in FIG. 22). When a liquid drop is discharged at time t01, a voltage V0 is applied to the piezo-electric element 220, which elongates to close the nozzle 210 (a 'closing' shown in FIG. 22).

Next, at time t1, the discharge signal of a liquid drop rises, and a voltage V1 is applied from the discharge control circuit 160 to the piezo-electric element 220. As a result, the piezo-electric element 220 shrinks to open the nozzle 210 (an 'opening' shown in FIG. 22). When a liquid drop is discharged at time t12, a voltage V0 is applied to the piezo-electric element 220, which elongates to close the nozzle 210 (a 'closing' shown in FIG. 22).

Next, at time t2, the discharge signal of a liquid drop does not rise, but a voltage applied from the discharge control circuit 160 to the piezo-electric element 220 remains V0. As a result, the piezo-electric element 220 remains elongated and the nozzle 210 remains closed (a 'closing' shown in FIG. 22).

As described above, according to the embodiment, it is possible to restrict a solution in nozzles and discharge tubes from being dried by an air stream that may be generated by the movement of the head unit or heat that may be generated at constructional elements of the device.

Further, the embodiment may be constructed without the guide of a liquid drop by laser beams. As such, the present invention provides a liquid discharge device comprising a discharge head for discharging a liquid drop to a substrate and means for opening/closing the discharge port of the discharge head at the time of discharging the liquid drop.

Fourth Embodiment

Next, a fourth embodiment of the present invention will be described. The fourth embodiment has a characteristic of performing an opening/closing control to nozzles in a different way from the third embodiment. Herein, a description will be made about differences of the fourth embodiment from the third embodiment.

Figure 23:
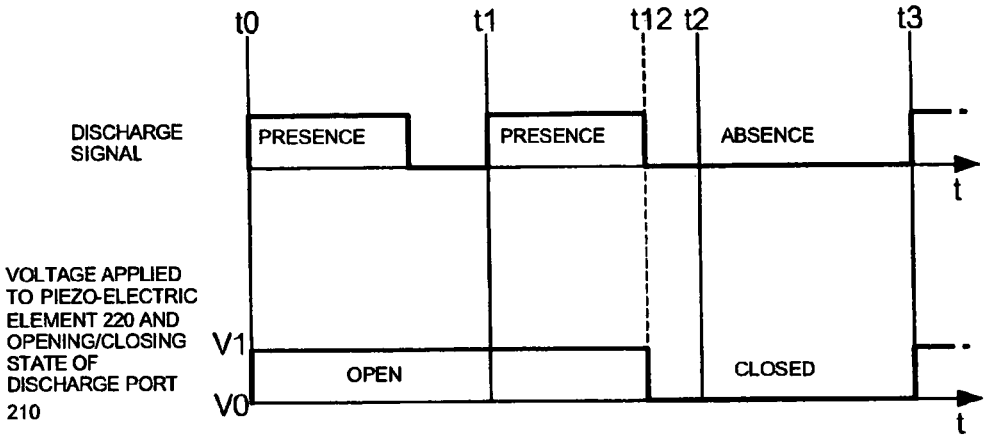
FIG. 23 is a timing chart illustrating the opening/closing states of the nozzle 210.

FIG. 23 is a timing chart illustrating changes in the opening/closing states of the nozzle 210 by the discharge signal supplied from the discharge control circuit 160 and piezo-electric element 220.

At time t0, the discharge signal of a liquid drop rises and a voltage V1 is applied to the piezo-electric element 220 from the discharge control circuit 160. Then, the piezo-electric element 220 shrinks to open the nozzle 210 (an 'opening' shown in FIG. 22). When a liquid drop is discharged at time t01, a voltage V0 is applied to the piezo-electric element 220, which elongates to close the nozzle 210 (a 'closing' shown in FIG. 22). At this time, a discharge signal is supplied at time t1 to the discharge control circuit 160. The discharge control circuit 160 determines whether there is a liquid drop discharged at time t1 or not. When a liquid drop is discharged, a voltage V1 is continually applied during the period of time from t0 to t1 to keep the nozzle 210 open.

Next, at time t1, a voltage V1 is applied from the discharge control circuit 160 to the piezo-electric element 220. Then, the piezo-electric element 220 keeps on shrinking to keep the nozzle 210 open (an 'opening' shown in FIG. 23). At this time, a discharge signal is supplied at time t2 to the discharge control circuit 160. The discharge control circuit determines whether there is a liquid drop discharged at time t2 or not. When a liquid drop is not discharged, a voltage V0 is applied at time t12 to the piezo-electric element 220. As a result, the piezo-electric element 220 elongates to close the nozzle 210.

As described above, according to the embodiment, it is possible to restrict a solution in nozzles and discharge tubes from being dried by an air stream that may be generated by the movement of the head unit or heat that may be generated at constructional elements of the device. Besides, when liquid drops keep on discharging, the nozzle is kept open to thereby omit unnecessary opening/closing operation. Therefore, the embodiment is suitable when the piezo-electric element having a slow opening/closing operation.

Further, the embodiment may be constructed without the guide of a liquid drop by laser beams. As such, the present invention provides a liquid discharge device comprising a discharge head for discharging a liquid drop to a substrate and means for opening a discharge port of the discharge head at the time of discharging a liquid drop, wherein when liquid drops keep on being discharged, the discharge port of the discharge head is kept open.

Fifth Embodiment

Next, a description will be made about a fifth embodiment of the present invention. An ink jet device 800 of the fifth embodiment is characterized in that an enclosure is provided in the head unit of the ink jet device according to the first or second embodiment. Moreover, in the fifth embodiment, there are no piezo-electric elements to prevent drying of nozzles. Hereinafter, a description will be made about differences in the fifth embodiment from the first or second embodiments.

Figure 24:
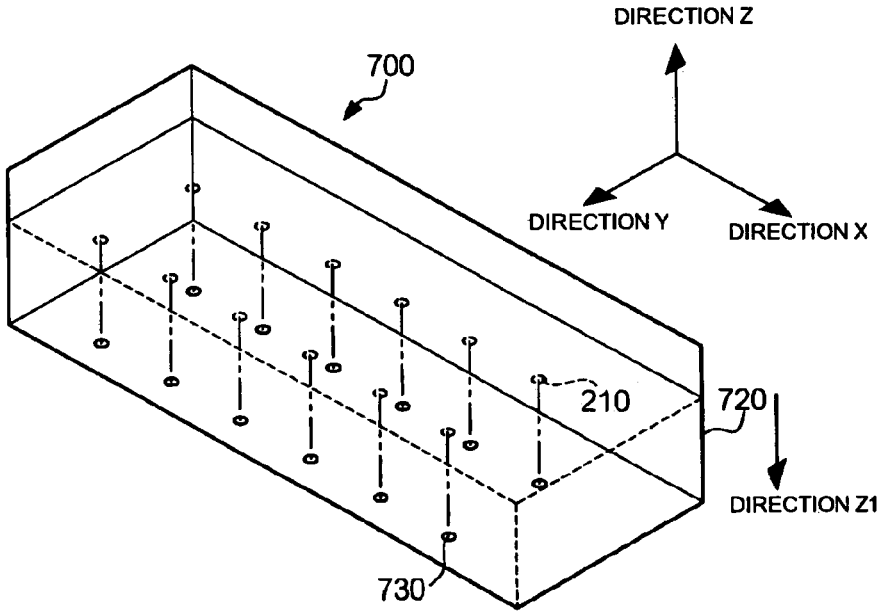
FIG. 24 is a perspective view of a head unit 700.

FIG. 24 is a perspective view of a head unit 700. The head unit 700 has twelve nozzles 210 in total to discharge liquid drops. The head unit 700 has an air tight enclosure separated from outside air. The enclosure 720 is hollow inside and has twelve holes 730 in total to pass liquid drops from the nozzles 210 to the flying trajectory (the direction of Z1) of liquid drops that are discharged from the nozzles 210.

Figure 25:
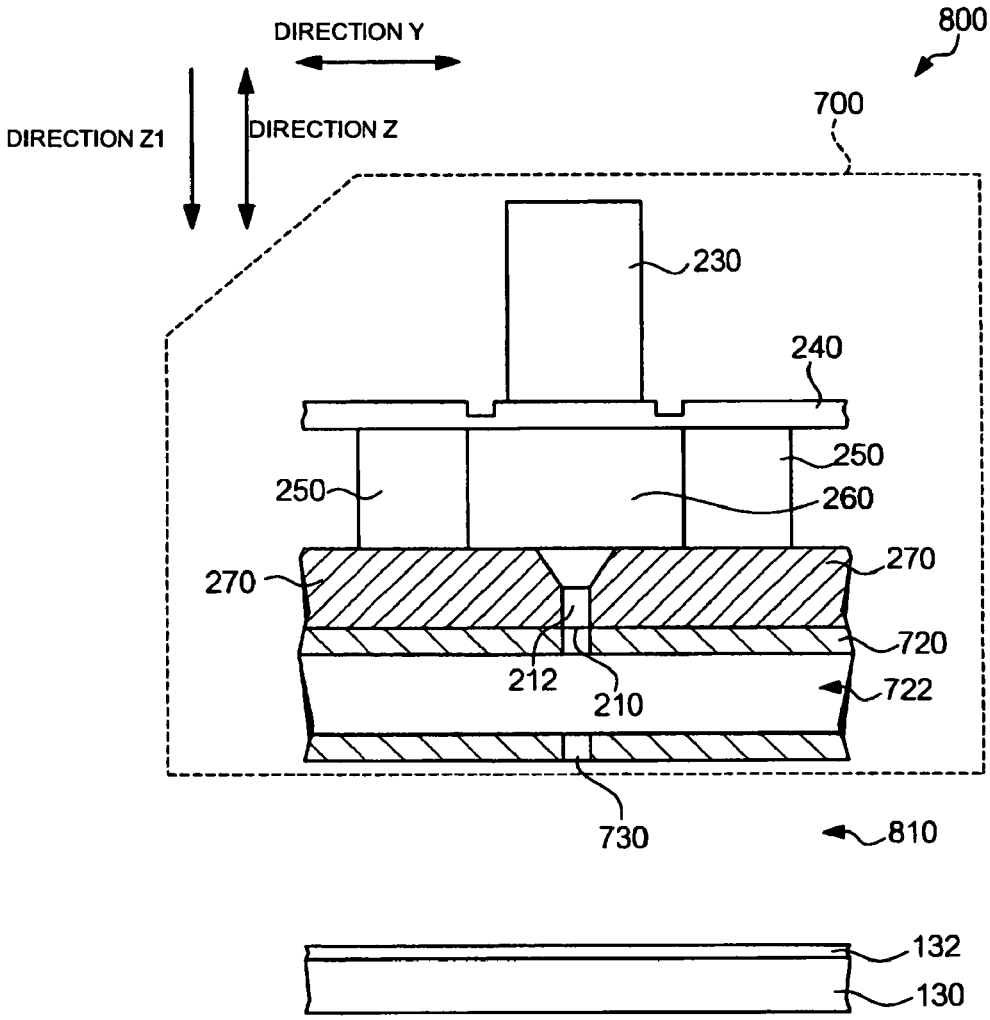
FIG. 25 is a cross-sectional view cut along the plane of YZ of the head unit 700.

FIG. 25 is a cross-sectional view of the head unit 700 cut along the YZ plane. FIG. 25 illustrates only a part corresponding to a single nozzle 210. The liquid drops discharged from the nozzle 210 pass through a hollow space 722 of the head unit 700 and a flying space 810 between two positions where the liquid drop flies and then are adhered to the substrate 132.

Figure 26:
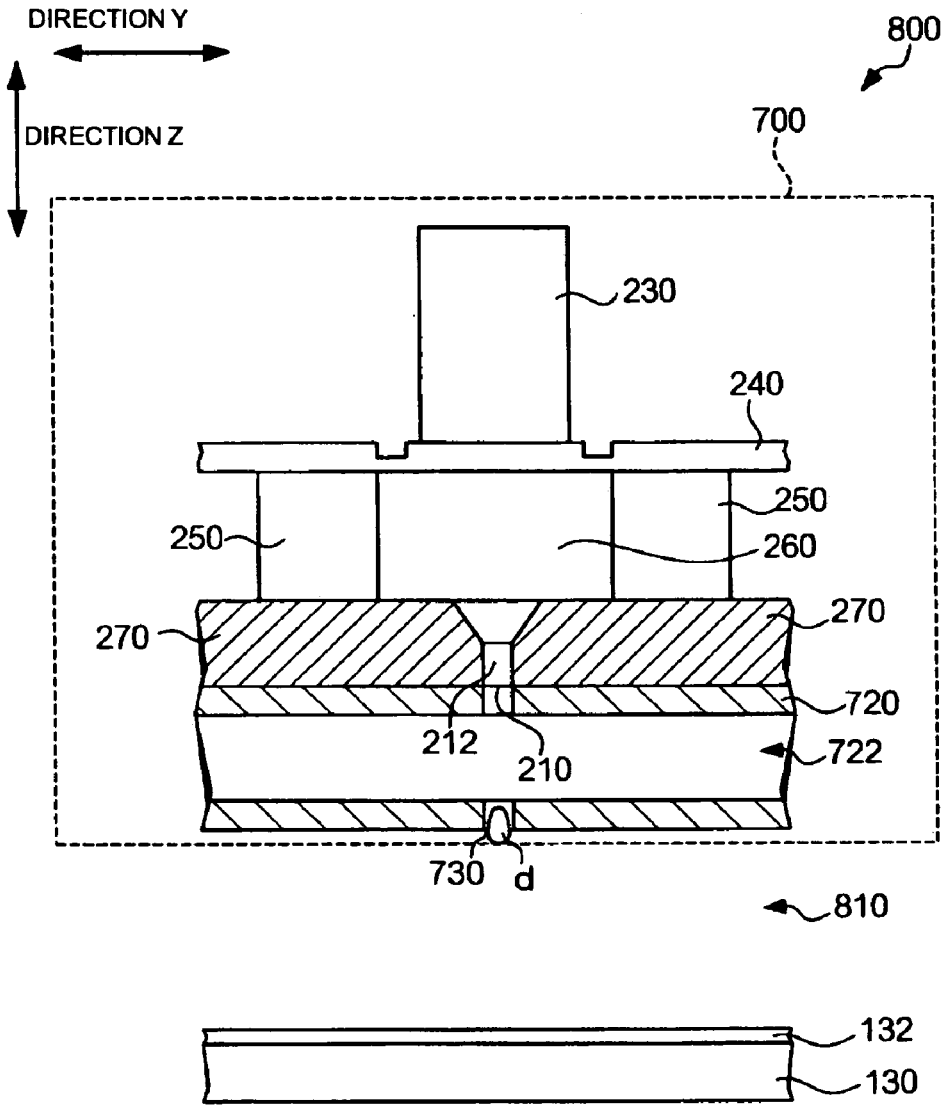
FIG. 26 illustrates the flying phase of a liquid drop d discharged from an ink jet device 800.

Next, the operation and effects of the ink jet device 800 will be described when the head unit 700 is driven to discharge a liquid drop. FIG. 26 illustrates a flying moment of a liquid drop d discharged through the nozzle 210 of the ink jet device 800. In this case, since the enclosure 720 is provided to cover the nozzle 210 in the head unit 700, the nozzle 210 is never exposed to an air stream generated by the movement of the head unit 700 or by heat of constructional elements of the device. As a result, it is possible to restrict the nozzle 210 and discharge tube 212 of the head unit 700 from drying.

On the other hand, the liquid drop d flies in the hollow space 722 to be hardly affected by the air stream until it passes through the hole 730. As a result of this, it is possible to prevent the liquid drop from being pushed by air stream and being directed to a position other than a predetermined one on the substrate 132. Further, the hole 730 is tiny and just large enough to pass the liquid drop d. As a result, the pressure of the hollow space 722 is kept higher than the flying space 810 because solvent in flying the liquid drop d vaporizes a little. Therefore, it is possible to restrict drying of the nozzle 210 and discharge tube 212.

As described above, according to the embodiment, it is possible to restrict drying of the nozzles and discharge tubes. Besides, it is possible to prevent a liquid drop from being pushed by an air stream and being directed to a position other than a predetermined one on the substrate.

Figure 27A:
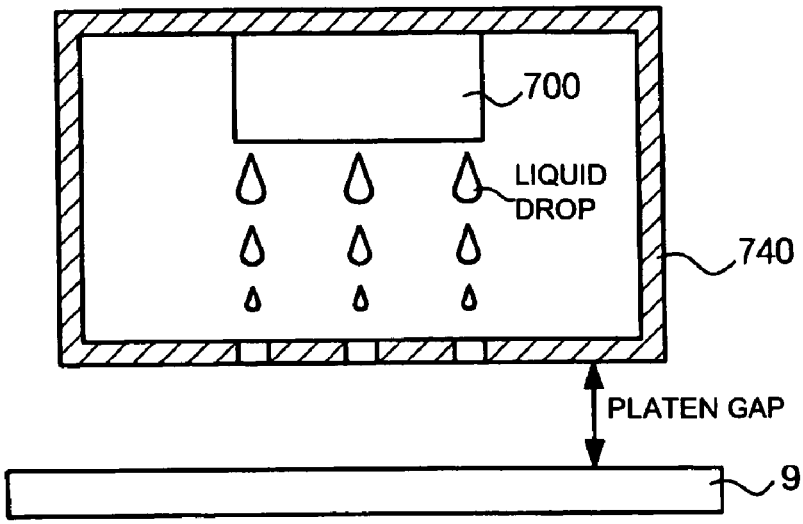
FIG. 27 illustrates an example having enclosures 740, 741.
Figure 27B:
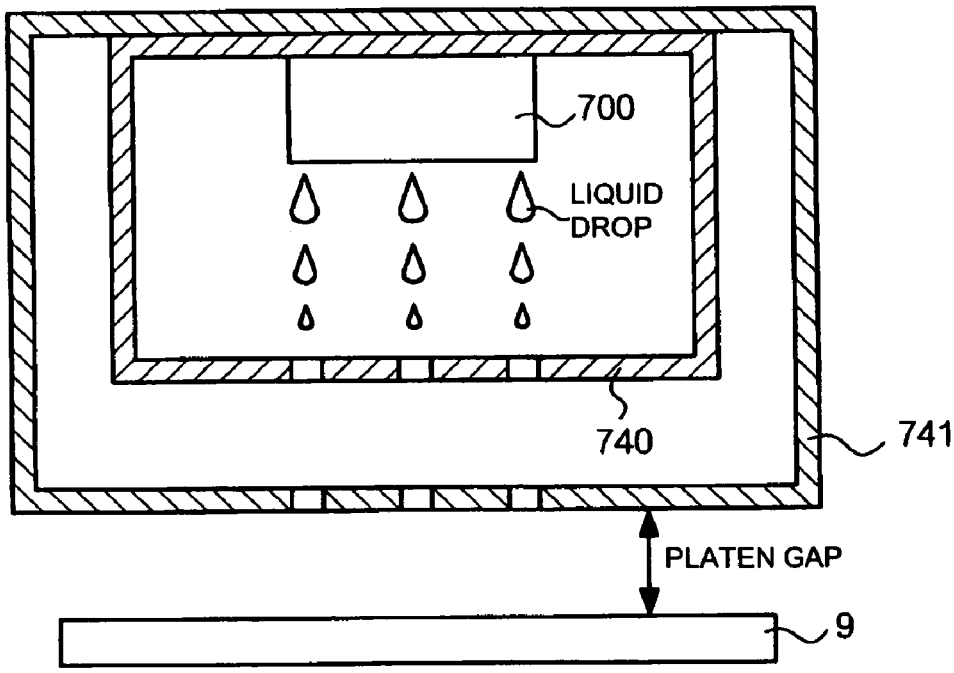

Further, as shown in FIG. 27(*a*), the structure of the whole head unit 700 can be accommodated in the enclosure 740. As shown in FIG. 27(*b*), another enclosure 741 larger than the enclosure 740 may be constructed outside the enclosure 740. Besides, the enclosures may be constructed in three or more folds. With the structure described above, the pressure around the nozzle 210 is kept higher than that of the flying space 810, so that it is possible to restrict drying of the nozzle 210 and discharge tube 212.

As auxiliary means to prevent clogging of the nozzle 210, vibration can be employed to the ink in the nozzle 210. The magnitude of vibration needs to be selected so that ink is not discharged out of the nozzle 210 by the vibration. In this case, ink is agitated by vibration, so that it is possible to prevent ink from solidifying despite a slight vaporization of solvent. Otherwise, UV hardened resin can be used as solvent. UV hardened resin is what turns into polymer when the resin is radiated with ultraviolet ray. Since the UV hardened resin is hard to vaporize and does not include solid contents even if it vaporizes, the resin will never solidify.

Further, the liquid drop discharge device may be constructed without the guide of a liquid drop by laser beams. As such, the present invention provides a liquid drop discharge device comprising a discharge head for discharging a liquid drop to the substrate and an enclosure for covering the discharge head, wherein the enclosure includes a hole that pass the liquid drop discharged from the discharge head.

Sixth Embodiment

Next, a description will be made about the sixth embodiment of the present invention. The sixth embodiment is characterized in that a hole 730 of an enclosure 720 in the ink jet device of the fifth embodiment is closed with a structure similar to that described in the third embodiment. Herein, a description will be made about differences in the structure of the sixth embodiment from that of the fifth embodiment.

Figure 28:
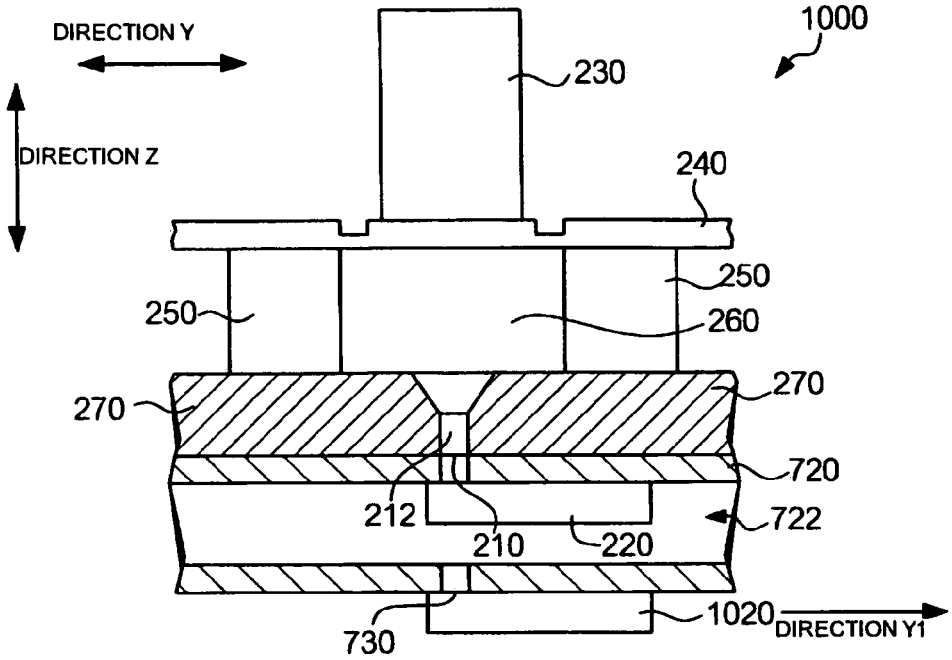
FIG. 28 illustrates a head unit 1000.

FIG. 28 illustrates a head unit 1000 constructed such that a piezo-electric element 1020 is used to close the hole 730 of the enclosure 720. The discharge control circuit of the sixth embodiment is constructed to output a voltage V1 or V0 to the piezo-electric element 1020 similarly to when the discharge control circuit 160 controls an opening/closing of the piezo-electric element 220 in the third embodiment.

The head unit 1000 has twelve nozzles 210 in total to discharge liquid drops. The head unit 1000 includes an enclosure 720 having a hole 730. The head unit 1000 has twelve piezo-electric elements 220 in total provided correspondingly to the nozzles 210 and twelve piezo-electric elements 1020 in total provided correspondingly to the holes 730. Voltages are respectively applied to the piezo-electric elements 220, 1020 to thereby change their shapes to shrink in the direction Y1, thereby making all of the nozzles 210 closed and holes 730 open.

The piezo-electric elements 220, 1020 of the head unit 1000 are respectively controlled to elongate or shrink by a discharge control circuit. At this time, the timewise changes in the discharge signals and the opening/closing states of the nozzles 210 and holes 730 are illustrated in FIG. 22.

As described above, according to the embodiment, the effects of the third and fifth embodiments can be obtained at the same time. As a result, it is possible to restrict drying of the nozzles and discharge tubes. Besides, it is possible to prevent a liquid drop from being pushed by an air stream and being directed to a position other than the predetermined one on the substrate.

Figure 29:
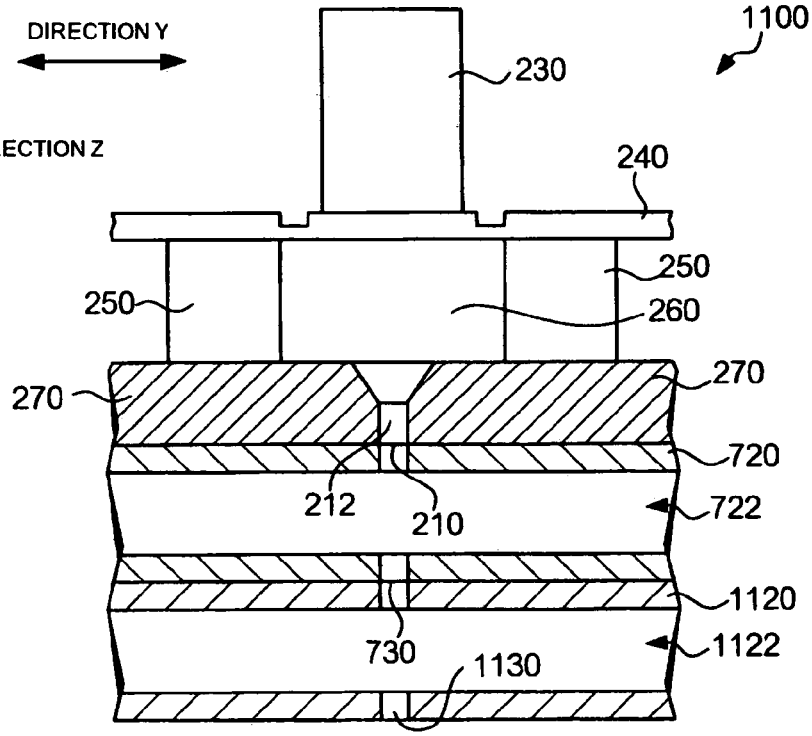
FIG. 29 illustrates a head unit 1100.

Further, except the enclosure 720 of the head unit 700 in the fifth embodiment, there may be provided another or a plurality of additional enclosures. FIG. 29 illustrates a head unit 1100 including enclosures 720 and 1120. The newly provided enclosure 1120 includes a hole 1130 in the trajectory where a liquid drop flies. Then, it is possible to keep the partial pressure of the solvent higher in the hole 1130 than in the hollow space 722 of the enclosure 720.

The piezo-electric element 220 may be arranged at one or both sides of the hole 730 of the enclosure 720 or at one or both sides of the hole 1130 of the enclosure 720 in the head unit 1100.

Moreover, the liquid drop discharge device may be constructed without the guide of a liquid drop by laser beams. As such, the present invention provides a liquid drop discharge device comprising a discharge head for discharging a liquid drop to a substrate, opening/closing means for opening a discharge port of the discharge head when the liquid drop is discharged and an enclosure for covering the discharge head. In this case, the enclosure has a hole to pass the liquid drop discharged from the discharge head.

Seventh Embodiment

Next, a description will be made about the seventh embodiment of the present invention. The seventh embodiment is characterized in that the head unit 200 and the substrate retaining plate 130 are sealed with an air tight material to decrease the internal pressure, in the ink jet device in the third embodiment. Herein, a description will be made about differences in the seventh embodiment from in the third embodiment.

Figure 30:
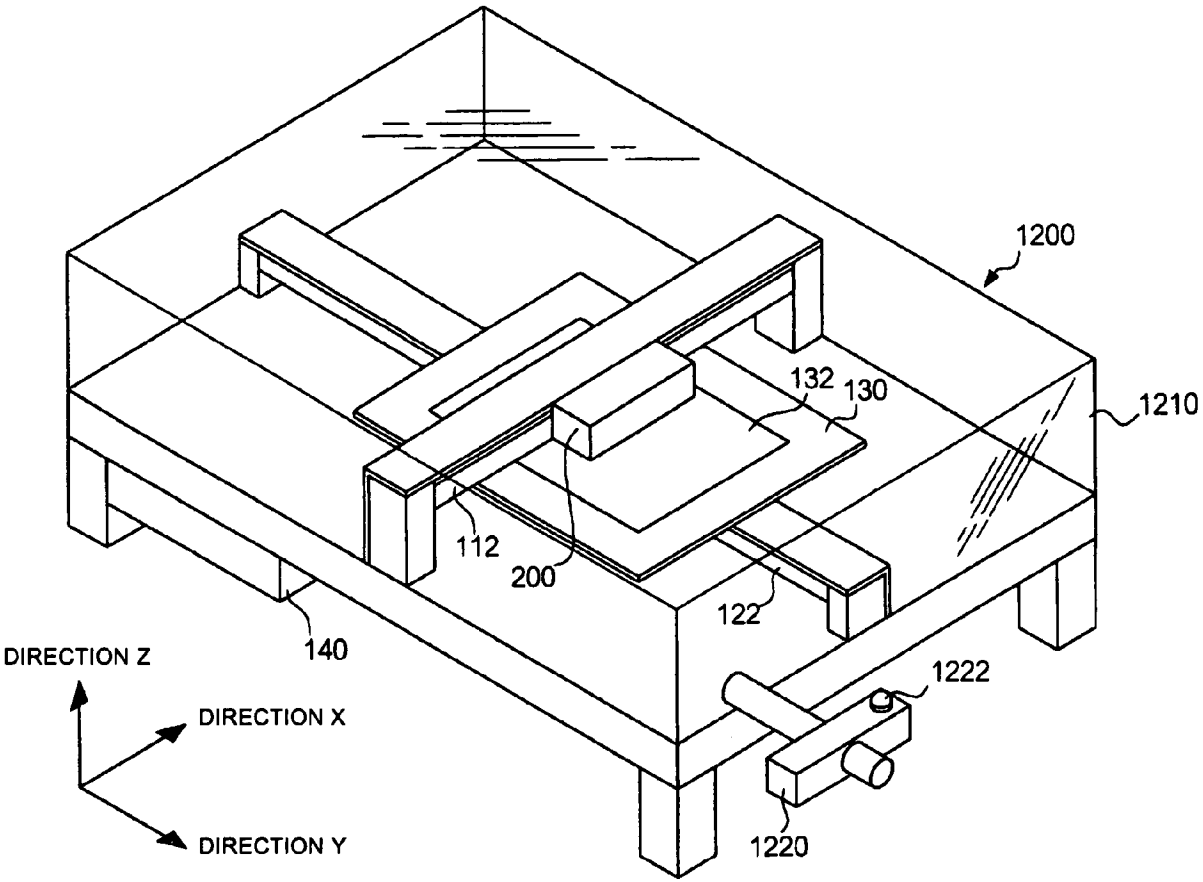
FIG. 30 is a perspective view of an ink jet device 1200.

FIG. 30 is a perspective view of an ink jet device 1200 according to this embodiment. The ink jet device 1200 is provided with a transparent, high air-tight sealed vessel 1210, which covers a head unit 200 and a substrate retaining plate 130. In the sealed vessel 1210, an air pressure control device 1220 is provided to keep the pressure in the sealed vessel 1210 lower than that (about one atmosphere) outside thereof or in vacuum. When a user presses down a pressure reducing button 1222, the air pressure control device 1220 opens a valve provided inside to discharge air or moisture filled in the sealed vessel 1210. Further, the air pressure control device 1220 discharges out air or moisture, and closes the valve when the inside of the sealed vessel 1210 reaches its preset degree of vacuum.

The degree of vacuum means that the average free stroke of gas inside the sealed vessel 1210 is equal to or greater than a platen gap. When the head unit has an enclosure or the like, the shortest distance from the enclosure to the substrate is defined as a platen gap. For example, when the platen gap is 10 cm, temperature 20° C., and pressure 1 mPa, a liquid drop can fly without being affected by air resistance to thereby land with precision. Further, the volume of a liquid drop in the embodiment is regarded as 100 femtoliters, so that the liquid drop can proceed straight only tens of microns in atmospheric air.

Figure 31:
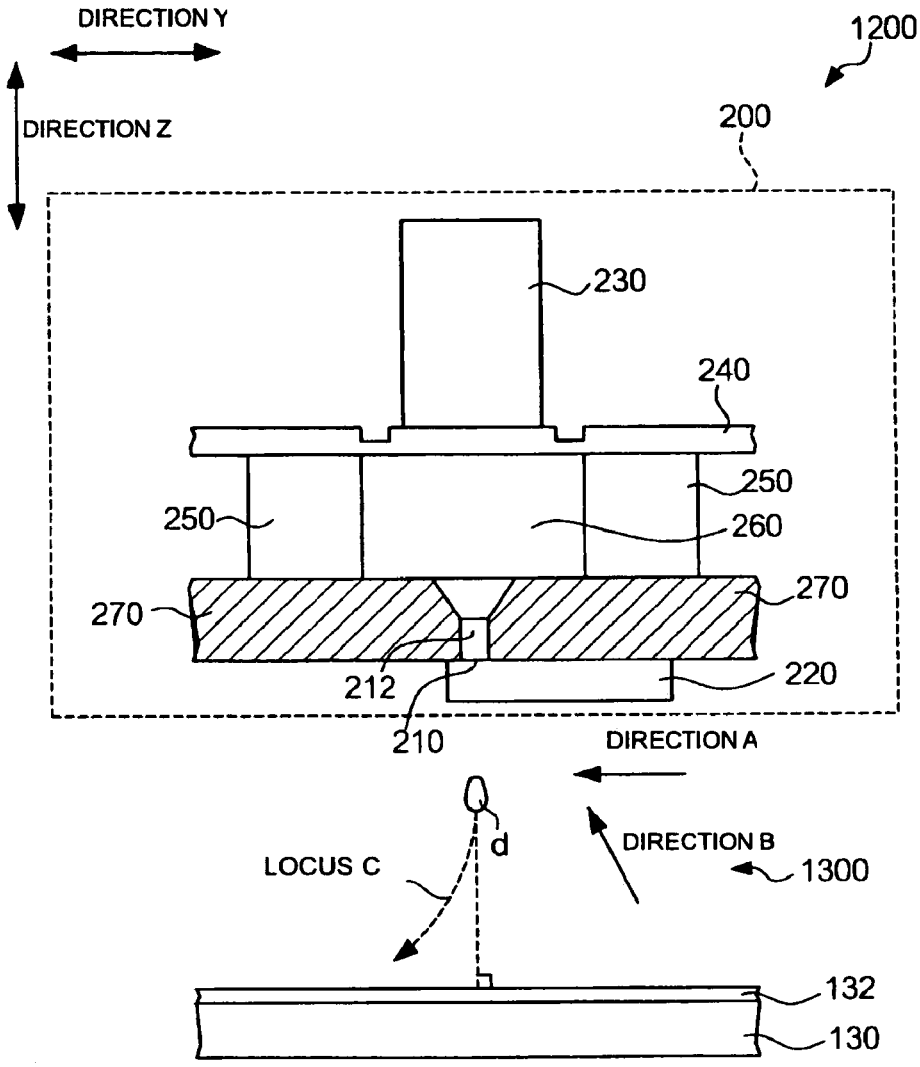
FIG. 31 illustrates the structure of the ink jet device 1200.

Next, the operation and effects of the ink jet device 1200 will be described. FIG. 31 illustrates a flying moment of a liquid drop d that is discharged from the nozzle 210 of the ink jet device 1200. Herein, in the case of a conventional ink jet device which is not provided with a sealed vessel 1210, the movement of the head unit in the x direction generates air stream going to the direction of A, for example. Besides, at the same time, a rising air stream is generated by heat of respective constructional elements themselves or a frictional heat of the driving axis when the ink jet device is in operation. Then, a tiny liquid drop d does not fall vertically to the substrate 132 because of the influence of such air stream, but is adhered to the substrate 132 by tracing a trajectory indicated as C, for example.

On the contrary, in the ink jet device 1200 of the present invention, the flying space of the liquid drop d is kept at a low pressure, it is possible to restrict generation of air stream. Therefore, the ink jet device 1200 emits the tiny liquid drop d, restricting the liquid drop from flowing away, and thereby making the liquid drop land at a predetermined position of the substrate 132.

However, the nozzle 210 is exposed to a low pressure of the flying space 1300, so that the solvent of the solution adhered to the nozzle 210 and the discharge tube 212 vaporizes to result in a phenomenon that a mass of solute narrows the nozzle 210 and the discharge tube. Along with such phenomenon, there are other problems like a difficulty in obtaining the desired volume of a liquid drop and a change in the flying direction of the liquid drop.

In an ink jet device 1200, the nozzle 210 of the head unit 200 is closed by the elongation of the piezo-electric element 220 that has shrunk after the discharge of a liquid drop d, as shown in the opening/closing operation of the nozzle 210 in FIG. 22. Therefore, a period of time that the nozzle 210 is exposed to the low pressure of the flying space 1300 can be reduced as short as the discharge operation of a liquid drop. It is also possible to restrict the phenomenon that the solvent of the solution adhered onto the nozzle 210 and the discharge tube 212 vaporizes to make the mass of solute narrow the nozzle 210 and discharge tube.

As described above, according to the embodiment, it is possible to restrict generation of an air stream in the flying space, which enables the liquid drop to be directed to a predetermined position on the substrate. Besides, the opening/closing of the discharge ports can stop the nozzles and the discharge tubes from drying.

Besides, the flying space is kept at a low level of pressure by the sealed vessel 1210, thereby achieving the following effects.

At the time of discharging a liquid drop, in general, as the liquid drop gets tiny, an effect of surface tension gets higher and, and the reaction of generating a liquid drop to vibration of the piezo-electric elements gets slower to thereby make discharge of a liquid drop difficult.

On the other hand, if the viscosity of a solution gets high, the reaction of generating a liquid drop to vibration of the piezo-electric elements gets slow to thereby make generation of a tiny liquid drop difficult. On the contrary, if the viscosity of a solution gets low, the reaction of generating a liquid drop to vibration of the piezo-electric elements gets better. However, the liquid drop may be easily bounded at the moment that the liquid drop is adhered onto the substrate 132, thereby causing a problem that the liquid drop is scattered.

Problems as such can be resolved by using the ink jet device 1200 of the present invention. In the ink jet device 1200 of the present invention the flying space of a liquid drop d is kept at a low level of pressure, so that a part of solvent such as water in the liquid drop d turns into a state that will easily vaporize in flying. Even if the liquid chamber 260 is filled with a solution having a low degree of viscosity to improve the reaction of generating a liquid drop, a part of the solvent is affected to vaporize during flying of the liquid drop d. Besides, the liquid drop d to be adhered to the substrate 132 has a higher level of viscosity than that to be discharged, thereby restricting scattering of a liquid drop.

At this time, as the inside of the sealed vessel 1210 gets closer to a vacuum state, the effect of air stream can be further restricted, and the phenomenon that the solvent vaporizes in flying of a liquid drop can be used positively.

Further, the ink jet device may be constructed without the guide of a liquid drop by laser beams. As such, the present invention provides a liquid discharge device comprising a discharge head for discharging a liquid drop to a substrate, a sealed vessel for sealing the discharge head and substrate, pressure reducing means for reducing the pressure inside the sealed vessel, and opening/closing means for opening a discharge port of the discharge head at the time of discharging the liquid drop.

Eighth Embodiment

Next, a description will be made about an eighth embodiment of the present invention. The eighth embodiment is characterized in that an enclosure is provided in the head unit of the ink jet device according to the seventh embodiment of the present invention.

Figure 32:
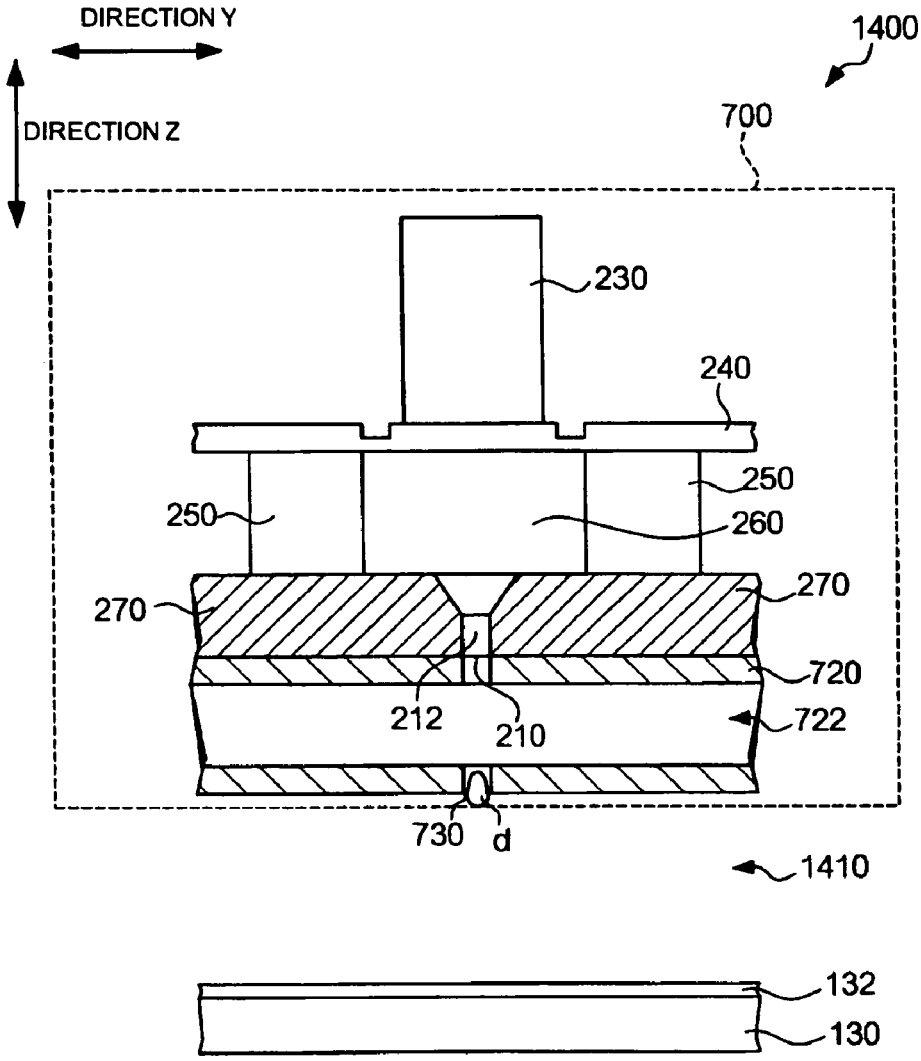
FIG. 32 illustrates the structure of an ink jet device 1400.

FIG. 32 illustrates the structure of an ink jet device 1400 according to the eighth embodiment of the present invention. The ink jet device 1400 comprises a head unit 700 of the fifth embodiment, instead of the head unit 200 of the seventh embodiment. The drawing illustrates a moment that a liquid drop d discharged from a nozzle 210 of the ink jet device 1400 flies.

According to the ink jet device 1400 of this embodiment, a hollow space 711 has a higher level of pressure than a flying space 1410 because of a slight vaporization of solvent of the flying liquid drop d. As a result, a difference in pressure between the nozzle 210 and a space neighboring to the nozzle 210 gets smaller, thereby restricting drying of the nozzle 210 and the discharge tube 212 in the head unit 700.

Other Embodiments Related to the Seventh or Eighth Embodiment

In the seventh or eighth embodiment, only one head unit according to the sixth embodiment is used for the ink jet device 1200 or the ink jet device 1400, thereby making it possible to restrict drying of the nozzle 210 and discharge tube 212 of the head unit.

Further, the ink jet device may be constructed without the guide of a liquid drop by laser beams. As such, the present invention provides a liquid discharge device comprising a discharge head for discharging a liquid drop to a substrate, a sealed vessel for sealing the discharge head and the substrate, pressure reducing means for reducing the pressure inside the sealed vessel, and an enclosure for covering the discharge head, wherein the enclosure includes a hole through which the liquid drop discharged from the discharge head is passed.

Various Applications of the Present Invention

The ink jet device described in the aforementioned first to eighth embodiments is an example, and the present invention may be modified at least as follows.

As described above, a piezo-electric element 220 is used as a cover to close the nozzle 210 in the head unit of the aforementioned embodiments. However, it is only an example, but other methods, for example, transformation by using static electricity or magnetic field, can also be applied to opening or closing the nozzle 210.

Besides, the head unit of the aforementioned embodiments has been described by using the piezo-electric element 220 that can close the nozzle 210. However, only a part of the discharge port of the nozzle 210 may be covered. In this case, while either a voltage V1 or V0 is supplied to the piezo-electric element 220 by the discharge control circuit 160 in the head unit of the third to fifth and the eighth embodiments as described above, a part of the nozzle 210 may be covered by supplying a level of voltage between V0 and V1 to the piezo-electric element 220, for example.

Besides, the head unit described above closes the nozzle 210 with a voltage V0 applied, for example, as described in FIG. 22. On the contrary, the nozzle 210 may be closed by the application of a voltage V1 while the nozzle 210 is kept open with a voltage V0 applied.

Figure 33:
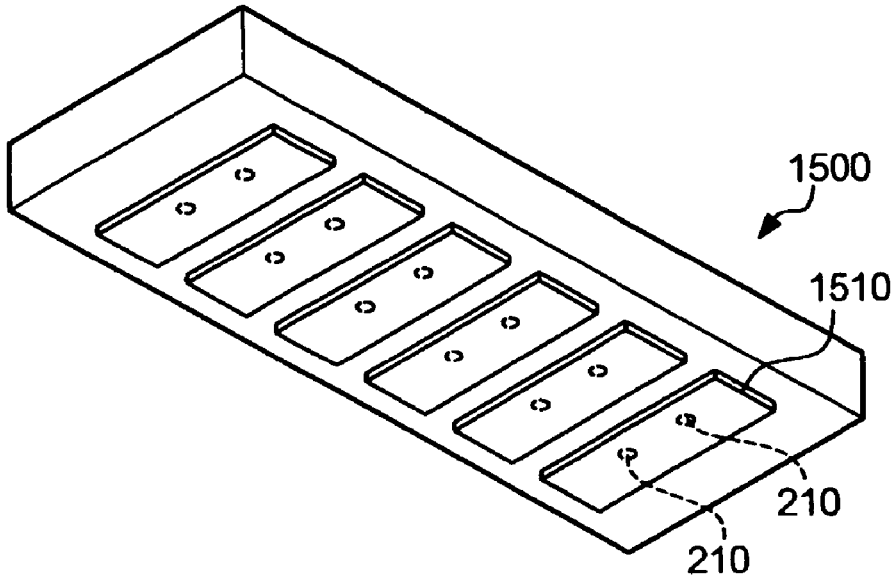
FIG. 33 illustrates piezo-electric elements 1510.
Figure 34:
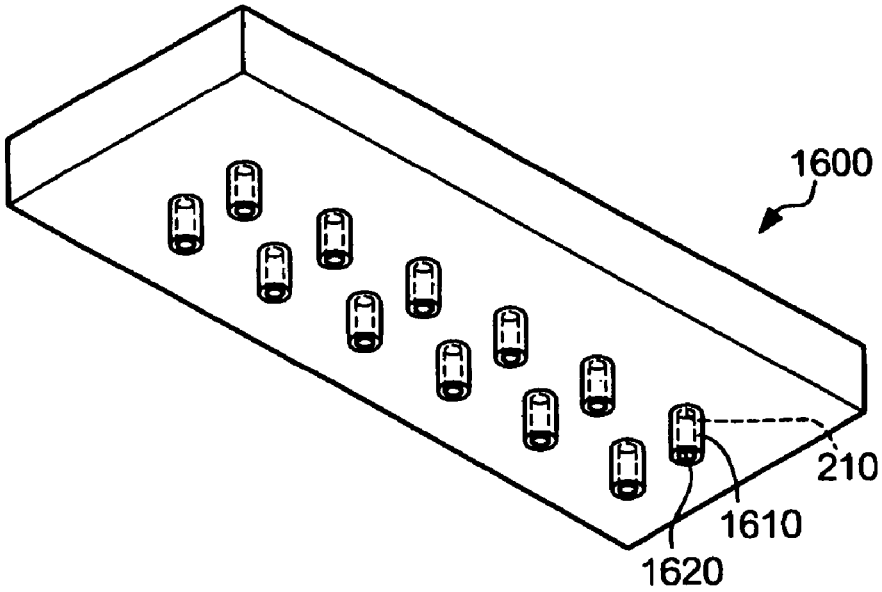
FIG. 34 illustrates an enclosure 1610.

In addition, in the head unit described above, one piezo-electric element 220 is used to control the opening or closing of one nozzle 210. As shown in FIG. 33, for example, one piezo-element 1510 may be constructed to control the opening or closing of two nozzles 210. In this case, as long as a liquid drop is not discharged from either of the two nozzles 210 by the discharge driving circuit, the nozzles 210 are closed by the piezo-electric element 1510. When any one of the two nozzles 210 discharges a liquid drop, a voltage V1 is supplied to the piezo-electric element to open the nozzles 210.

Further, the head unit 700 according to the fifth embodiment comprises the enclosure 920 that entirely covers all of the twelve nozzles 210. However, one hollow enclosure 1610 may be constructed to cover one nozzle 210. In this case, one enclosure 1610 is provided with a hole 1620 through which a liquid drop discharged from the nozzle 210 is passed.

Moreover, in the ink jet device according to the third to eighth embodiments, the head unit is moved in the x direction in such a scanning way and the substrate retaining plate 130 is moved in the y direction in such a scanning way, thereby making it possible to adhere a liquid drop to a predetermined position of the substrate 132. However, the ink jet device can be constructed with the head unit fixed and with the substrate retaining plate 130 being properly moved in such a scanning way to thereby performing adhesion of a liquid drop. In contrast to the aforementioned example, the ink jet device can be constructed with the substrate retaining plate 130 fixed and with the head unit being properly moved in such a scanning way to thereby performing adhesion of a liquid drop.

Besides, in the ink jet device of the fifth and sixth embodiment, the air pressure control device 1220 manipulated by a user properly reduces the air pressure inside the sealed vessel 1210 to a predetermined level of air pressure when the substrate 132 is coated with a solution. However, the air pressure reducing process may be automated. In this case, while a solution is coated onto the substrate 132, an object to be coated, the air pressure control device 1220 of the ink jet device detects at every predetermined period of time (for example, thirty seconds) whether a preset level of air pressure is kept inside the sealed vessel 1210. When it is detected that a predetermined level of air pressure is not kept inside the sealed vessel 1210, the air control device of the ink jet device opens a valve to carry out air pressure reducing process to the inside of the sealed vessel 1210 to set up a predetermined level of air pressure. When a predetermined level of air pressure is set up, the air pressure control device 1220 closes the valve. Herein, the air pressure detecting time inside the sealed vessel 1210 with the air pressure control device 1220 is not every predetermined period of time, but every previously set time (for example, 30, 70, 200, . . . , seconds, etc.). Additionally, when the air pressure reducing process is performed with the air pressure control device 1220, it is preferable to stop a discharge of a solution from the head unit in consideration of air stream that may be generated by sucked (vacuum) air.

Besides, in relation to the automation of the air pressure reducing process, an automatic air pressure control may be carried out depending on the estimated total quantity of the solution discharged from the ink jet device. In this case, a connection line is connected to the air pressure control device 1220 to obtain discharge-driving data from the drive control circuit 140. The discharge-driving data make it possible to estimate the size of a liquid drop. Then, the discharge-driving data obtained by the air pressure control device 1220 is accumulated. The air pressure control device 1220 performs an air pressure reducing process to the inside of the sealed vessel to set up to a predetermined level of air pressure when the predetermined total quantity of discharged a solution is detected. In the aforementioned method, it is possible to estimate the amount of the solvent such as moisture that vaporizes along with the discharge or scattering of a liquid drop on the basis of the size of a liquid drop, and it is helpful to determine the removal of solvent inside the sealed vessel 1210.

Further, the ink jet device described above is constructed such that the head unit and a medium (substrate, sheet or the like) are covered with an airtight member as described above so as to keep the flying space of a liquid drop discharged from the head unit sealed. However, if the conventional ink jet device is used inside a chamber or a place that is kept in an atmosphere of a low pressure or vacuum, it is possible to obtain the same effect as described above.

The ink jet device of the present invention can also be used as a device for coating resist of a lithography process at the time of forming a conductive layer pattern, for coating light permeable material to a disc having a plurality of inflated portions in the process of manufacturing a micro lens array, or for measuring type or quantity of biological material like deoxyribonucleic acid (DNA) injected to a container.

Besides, the ink jet device of the present invention can also be used as a device for forming a layer such as a hole-transporting light-emitting layer or an electron-transporting layer in an organic EL element, or a device for forming a fluorescent layer in a nonorganic EL element.

In addition, the ink jet device of the present invention can be used as a wiring line forming device in a field emission display (FED), a plasma display panel (PDP) or the like. Hereinafter, an electro-optical device having EL elements formed using an ink jet device of the present invention and an electronic apparatus having the electro-optical device as a display unit will be described below.

Figure 35:
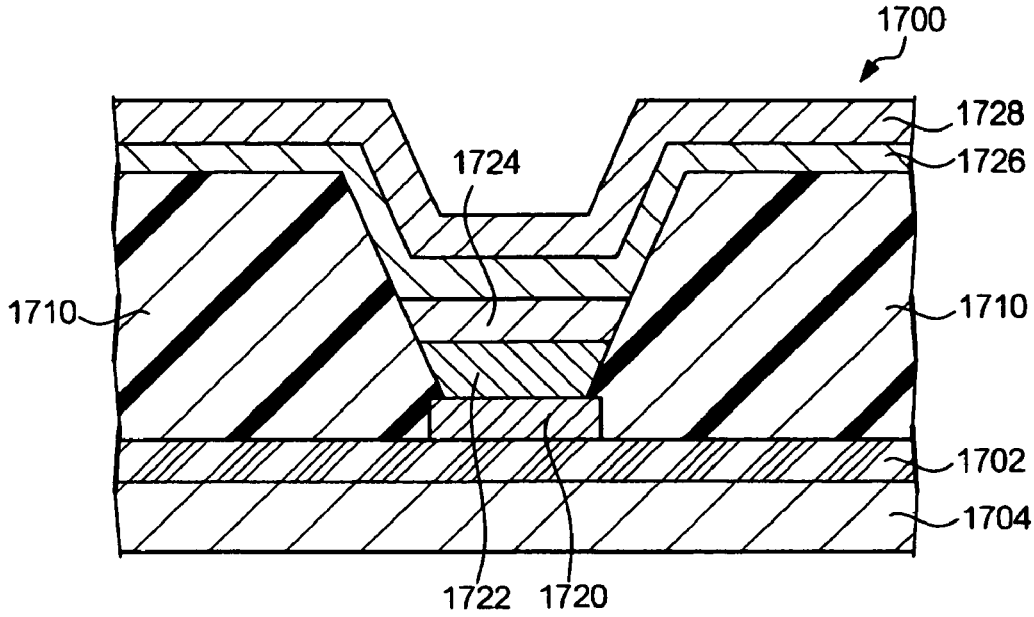
FIG. 35 illustrates an EL display device 1700.

FIG. 35 illustrates an EL display device 1700 of a top emission structure having EL elements formed using the aforementioned ink jet device 100. In the process of manufacturing the EL display device 1700, O2 plasma treatment is performed in a region surrounded with a partition layer 1710 as a surface treatment to improve a surface applicability of a positive electrode layer 1712 on a glass substrate 1704 through a buffer layer 1702, and then a plasma treatment is performed under gas having a fluorine property to make the surface of the partition layer 1710 water-repellent. Then, the ink jet device 100 is used to discharge hole transport material such as aromatic amine derivatives to form a hole transport layer 1722 and light-emitting polymer material such as p-phenylene vinyl (PPV) to form a light-emitting layer 1724. Next, a vacuum deposition method makes it possible to form an electron-injecting negative electrode layer 1726 with calcium, magnesium or some other material, and a sputtering method makes it possible to form a negative electrode layer 1728 with aluminum having reflectivity.

Besides, a description is made about an EL display device 1700 constructed by the ink jet device 100 as an example. However, a liquid crystal display device having color filters constructed by an ink jet device of the present invention may be used.

Figure 36:
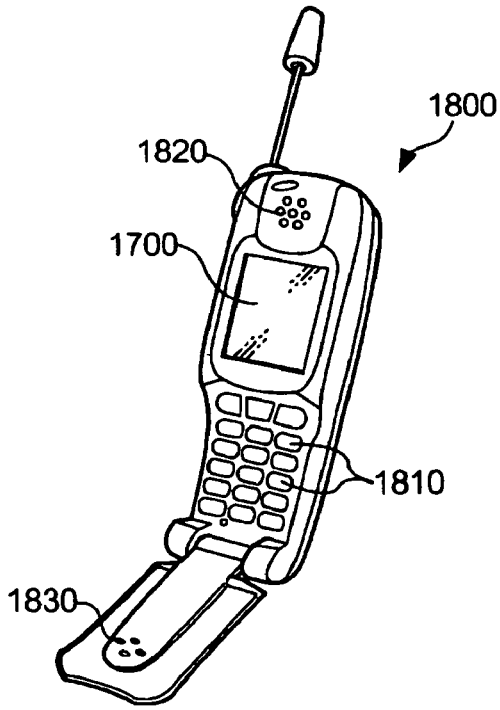
FIG. 36 illustrates a cellular phone 1800.

FIG. 36 illustrates an external view of a cellular phone 1800 equipped with an EL display device 1700. In the drawing, the cellular phone 1800 comprises an EL display device 1700 as a display unit that displays various kinds of information such as telephone numbers, along with a plurality of manipulating buttons 1810, an earpiece 1820 and a mouthpiece 1830.

In addition to the cellular phone 1800, the EL display device 1700 manufactured using the ink jet device of the present invention can be utilized as a display unit in computers, projectors, digital cameras, movie cameras, personal digital assistant (PDA), vehicle mounted devices, copier, audio equipment, or other electronic apparatuses.

The entire disclosures of Japanese Patent Application Nos. 2003-012705 filed Jan. 21, 2003, 2003-054672 filed Feb. 28, 2003, 2003-054673 filed Feb. 28, 2003 and 2003-381756 filed Nov. 11, 2003 are incorporated by reference.

What is claimed is:

1. A liquid drop discharge device, comprising:

a substrate;

a plurality of discharge heads supported above the substrate, each of the discharge heads having a nozzle and selectively discharging liquid drops through the nozzle to the substrate, the liquid drops from each of the discharge heads having a predetermined trajectory from the nozzles to the substrate; and a plurality of laser devices each supported proximate one of the discharge heads, each of the laser devices having a plurality of lenses surrounding the nozzle of one of the discharge heads, each of the laser devices emitting a plurality of light beams surrounding the predetermined trajectory of liquid drops from one of the discharge heads, the light beams providing light energy to the liquid drops when the liquid drops divert from the predetermined trajectories.

2. The liquid drop discharge device according to claim 1, wherein the light beams drive the liquid drops by light pressure generated by the light energy.

3. The liquid drop discharge device according to claim 1, wherein the light beams drive the liquid drops by kinetic energy of molecules generated when atmosphere around the predetermined trajectories absorbs the light energy.

4. The liquid drop discharge device according to claim 1, wherein the liquid drops contain a photothermal converting material for absorbing and converting the light energy into heat.

5. A printing device comprising the liquid drop discharge device according to claim 1, wherein the liquid drop discharge device is used to carry out printing.

6. The liquid drop discharge device according to claim 1, wherein the plurality of light beams are spaced apart from the predetermined trajectory of the liquid drops.

7. The liquid drop discharge device according to claim 1, wherein the plurality of light beams extend from the one of the discharge heads in the same direction as the liquid drops discharged from the one discharge head.

8. The liquid drop discharge device according to claim 1, wherein the plurality of light beams axially surround the one of the discharge heads and the predetermined trajectory.

9. The liquid drop discharge device according to claim 1, wherein the plurality of light beams cooperate to form a hollow laser beam.

10. The liquid drop discharge device according to claim 9, wherein said predetermined trajectory extends through the hollow laser beam without contacting any of the plurality of light beams.

11. The liquid drop discharge device according to claim 10, wherein the hollow laser beam directs liquid drops that divert from the predetermined trajectory back towards a hollow portion of the hollow laser beam and toward the predetermined trajectory.

12. A liquid drop discharge device, comprising:

a stage;

a substrate supported on the stage, the stage and the substrate being capable of transmitting light;

a discharge head disposed so as to face the substrate, the discharge head selectively discharging liquid drops to the substrate, the liquid drops having a predetermined trajectory from the discharge head to the substrate; and a head unit disposed so as to face the stage opposite the discharge head, the head unit including a laser device emitting a plurality of light beams through the stage and the substrate, the light beams spaced apart from and surrounding the predetermined trajectory of the liquid drops and extending in the same direction as the liquid droplets discharged from the discharge head, the light beams providing light energy to the liquid drops when the liquid drops divert from the predetermined trajectory, the head unit further including a collimator and a diffracting element disposed between the laser device and the stage so that the light beams pass therethrough.

13. The liquid drop discharge device according to claim 12, wherein the plurality of light beams axially surround the discharge head and the predetermined trajectory.

14. The liquid drop discharge device according to claim 12, wherein the plurality of light beams cooperate to form a hollow laser beam.

15. The liquid drop discharge device according to claim 14, wherein said predetermined trajectory extends through the hollow laser beam without contacting any of the plurality of light beams.

16. The liquid drop discharge device according to claim 15, wherein the hollow laser beam directs liquid drops that divert from the predetermined trajectory back towards a hollow portion of the hollow laser beam and toward the predetermined trajectory.

* * * * *